US009975340B2

(12) United States Patent
Karita et al.

(10) Patent No.: US 9,975,340 B2
(45) Date of Patent: May 22, 2018

(54) PRINTING APPARATUS AND MEDIUM

(71) Applicant: CANON KABUSHIKI KAISHA, Tokyo (JP)

(72) Inventors: Seiichiro Karita, Saitama (JP); Shuzo Iwanaga, Kawasaki (JP); Kazuhiro Yamada, Yokohama (JP); Akio Saito, Machida (JP); Zentaro Tamenaga, Sagamihara (JP); Shingo Okushima, Kawasaki (JP); Yumi Komamiya, Kawasaki (JP); Tatsurou Mori, Yokohama (JP); Takatsuna Aoki, Yokohama (JP); Noriyasu Nagai, Tokyo (JP); Akira Yamamoto, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/382,039

(22) Filed: Dec. 16, 2016

(65) Prior Publication Data

US 2017/0197417 A1 Jul. 13, 2017

(30) Foreign Application Priority Data

Jan. 8, 2016 (JP) ..... 2016-002825

(51) Int. Cl.
*B41J 2/155* (2006.01)
*B41J 2/18* (2006.01)
(Continued)

(52) U.S. Cl.
CPC ..... *B41J 2/16505* (2013.01); *B41J 2/14112* (2013.01); *B41J 2/155* (2013.01); *B41J 2/18* (2013.01)

(58) Field of Classification Search
CPC . B41J 2/14112; B41J 2/175; B41J 2/18; B41J 2202/12; B41J 2202/21; B41J 2202/14475
See application file for complete search history.

(56) References Cited

U.S. PATENT DOCUMENTS 4,737,801 A 4/1988 Ichihashi et al. ..... 347/85
4,748,459 A 5/1988 Ichihashi et al. ..... 347/31
(Continued)

FOREIGN PATENT DOCUMENTS

JP 2005-271337 10/2005
JP 2014-141032 8/2014

OTHER PUBLICATIONS

U.S. Appl. No. 15/382,027, filed Dec. 16, 2016.
(Continued)

*Primary Examiner* — Anh T. N. Vo
(74) *Attorney, Agent, or Firm* — Fitzpatrick, Cella, Harper & Scinto

(57) ABSTRACT

In a printing apparatus including a circulation system circulating a liquid, a volatile component included in the liquid evaporates from an ejection opening and thus characteristics of the liquid involving with concentration, viscosity and the like change. The invention provides a printing apparatus including: a page wide type liquid ejection head that includes an ejection opening ejecting a liquid, a print element generating energy for ejecting a liquid, and a pressure chamber having the print element provided therein; a cap that covers the ejection opening; and a circulator configured to circulate the liquid so that the liquid passes through the pressure chamber, wherein a circulation of the liquid is started after the cap is opened and the circulation of the liquid is stopped in a case where an image forming operation of ejecting the liquid from the ejection opening on the basis of a job is ended.

11 Claims, 31 Drawing Sheets

(51) Int. Cl.
*B41J 2/165* (2006.01)
*B41J 2/14* (2006.01)

(56) References Cited

U.S. PATENT DOCUMENTS

| | | | | |
|---|---|---|---|---|
| 4,896,172 | A | 1/1990 | Nozawa et al. | 347/17 |
| 4,908,636 | A | 3/1990 | Saito et al. | 347/25 |
| 5,051,759 | A | 9/1991 | Karita et al. | 347/87 |
| 5,155,502 | A | 10/1992 | Kimura et al. | 347/87 |
| 5,166,707 | A | 11/1992 | Watanabe et al. | 347/3 |
| 5,189,443 | A | 2/1993 | Arashima et al. | 347/63 |
| 5,216,446 | A | 6/1993 | Satoi et al. | 347/65 |
| 5,237,342 | A | 8/1993 | Saikawa et al. | 347/87 |
| 5,251,040 | A | 10/1993 | Saito | 358/296 |
| 5,280,299 | A | 1/1994 | Saikawa et al. | 347/87 |
| 5,291,215 | A * | 3/1994 | Nozawa | B41J 2/1408 347/18 |
| 5,329,304 | A | 7/1994 | Koizumi et al. | 347/7 |
| 5,471,230 | A | 11/1995 | Saito et al. | 347/29 |
| 5,481,283 | A | 1/1996 | Watanabe et al. | 347/33 |
| 5,481,290 | A | 1/1996 | Watanabe et al. | 347/104 |
| 5,483,267 | A | 1/1996 | Nemura et al. | 347/32 |
| 5,488,395 | A | 1/1996 | Takayanagi et al. | 347/7 |
| 5,500,666 | A | 3/1996 | Hattori et al. | 347/87 |
| 5,502,479 | A | 3/1996 | Ishinaga et al. | 347/93 |
| 5,515,091 | A | 5/1996 | Kimura et al. | 347/86 |
| 5,548,309 | A | 8/1996 | Okubo et al. | 347/33 |
| 5,559,536 | A | 9/1996 | Saito et al. | 347/25 |
| 5,619,238 | A | 4/1997 | Higuma et al. | 347/86 |
| 5,623,287 | A | 4/1997 | Saikawa et al. | 347/47 |
| 5,629,728 | A | 5/1997 | Karita et al. | 347/87 |
| 5,689,290 | A | 11/1997 | Saito et al. | 347/7 |
| 5,703,632 | A | 12/1997 | Arashima et al. | 347/47 |
| 5,757,399 | A | 5/1998 | Murayama et al. | 347/32 |
| 5,864,352 | A | 1/1999 | Aoki et al. | 347/102 |
| 5,917,514 | A | 6/1999 | Higuma et al. | 347/29 |
| 5,917,524 | A | 6/1999 | Kimura et al. | 347/86 |
| 6,012,795 | A | 1/2000 | Saito et al. | 347/7 |
| 6,048,045 | A | 4/2000 | Nohata et al. | 347/7 |
| 6,056,386 | A | 5/2000 | Nohata et al. | 347/19 |
| 6,123,420 | A | 9/2000 | Higuma et al. | 347/86 |
| 6,247,784 | B1 | 6/2001 | Obana et al. | 347/37 |
| 6,250,752 | B1 | 6/2001 | Tajima et al. | 347/92 |
| 6,286,945 | B1 | 9/2001 | Higuma et al. | 347/86 |
| 6,290,344 | B1 | 9/2001 | Saikawa et al. | 347/86 |
| 6,332,673 | B1 | 12/2001 | Higuma et al. | 347/86 |
| 6,382,786 | B2 | 5/2002 | Iwanaga et al. | 347/86 |
| 6,406,118 | B1 | 6/2002 | Aoki et al. | 347/16 |
| 6,419,341 | B1 | 7/2002 | Nohata et al. | 347/19 |
| 6,419,349 | B1 | 7/2002 | Iwanaga et al. | 347/86 |
| 6,474,801 | B2 | 11/2002 | Higuma et al. | 347/86 |
| 6,527,381 | B1 | 3/2003 | Udagawa et al. | 347/86 |
| 6,652,949 | B2 | 11/2003 | Iwanaga et al. | 428/65.9 |
| 6,688,735 | B2 | 2/2004 | Higuma et al. | 347/86 |
| 6,742,881 | B2 | 6/2004 | Kotaki et al. | 347/86 |
| 6,796,643 | B2 | 9/2004 | Higuma et al. | 347/85 |
| 8,205,973 | B2 * | 6/2012 | Nitta | B41J 2/175 347/85 |
| 8,851,639 | B2 * | 10/2014 | Arimoto | B41J 2/175 347/85 |
| 9,073,336 | B1 * | 7/2015 | Matsumoto | B41J 2/17596 |
| 9,315,041 | B2 | 4/2016 | Moriguchi et al. | B41J 2/18 |
| 9,327,513 | B2 | 5/2016 | Moriguchi et al. | B41J 2/175 |
| 9,358,803 | B2 | 6/2016 | Moriguchi et al. | B41J 2/175 |
| 2002/0113853 | A1 | 8/2002 | Hattori et al. | 347/86 |
| 2003/0043241 | A1 | 3/2003 | Hattori et al. | 347/86 |

OTHER PUBLICATIONS

U.S. Appl. No. 15/387,340, filed Dec. 21, 2016.
U.S. Appl. No. 15/387,334, filed Dec. 21, 2016.
U.S. Appl. No. 15/382,048, filed Dec. 16, 2016.
U.S. Appl. No. 15/380,584, filed Dec. 15, 2016.

* cited by examiner

PRINTING APPARATUS AND MEDIUM

BACKGROUND OF THE INVENTION

Field of the Invention

The present invention relates to a printing apparatus and a medium.

Description of the Related Art

In the field of an inkjet printing head, since a volatile component of ink evaporates from an ejection opening, characteristics of the ink in the vicinity of the ejection opening change. Accordingly, some problems arise in that unevenness in color is caused by a change in color concentration or deterioration in landing accuracy is caused by a change in ejection speed in accordance with an increase in viscosity. As a countermeasure for such a problem, there is known a method of circulating ink supplied to an inkjet printing head through a circulation path. However, in this method, since the ink is circulated so that fresh ink is supplied to a front end of a nozzle at all times, moisture normally evaporates from the front end of the nozzle. As a result, a problem arises in that concentration of the ink gradually increases in an entire circulation system.

In order to handle the above-described problem, Japanese Patent Laid-Open No. 2005-271337 discloses a method of adjusting concentration of ink of a circulation system to be uniform by predicting an ink consumption amount or an ink evaporation amount and replenishing thick ink or dilute solution prepared in advance on the basis of the prediction.

SUMMARY OF THE INVENTION

However, in the method disclosed in Japanese Patent Laid-Open No. 2005-271337, since the thick ink or the dilute solution is needed and a concentration sensor for at least one color is needed, the system becomes complex. As a result, a problem also arises in that a cost increases.

The present invention is made in view of the above-described circumstances and an object of the present invention is to suppress an increase in concentration of a liquid flowing through a circulation system by suppressing an evaporation of a volatile component from an ejection opening without causing an increase in cost in terms of a simple configuration compared with the related art.

The present invention provides a printing apparatus including: a page wide type liquid ejection head that includes an ejection opening ejecting a liquid, a print element generating energy for ejecting a liquid, and a pressure chamber having the print element provided therein; a cap that covers the ejection opening; and a circulator configured to circulate the liquid so that the liquid passes through the pressure chamber, wherein a circulation of the liquid is started after the cap is opened and the circulation of the liquid is stopped in a case where an image forming operation of ejecting the liquid from the ejection opening on the basis of a job is ended.

Further features of the present invention will become apparent from the following description of exemplary embodiments (with reference to the attached drawings).

DESCRIPTION OF THE EMBODIMENTS

Hereinafter, a liquid ejection head and a liquid ejection apparatus according to application examples and embodiments of the present invention will be described with reference to the drawings. In the application examples and the embodiments below, detailed configurations of an inkjet printing head and an inkjet printing apparatus ejecting ink will be described, but the present invention is not limited thereto. The liquid ejection head, the liquid ejection apparatus, and the liquid supply method of the present invention can be applied to a printer, a copying machine, a facsimile having a communication system, a word processor having a printer, and an industrial printing apparatus combined with various processing devices. For example, the liquid ejection head, the liquid ejection apparatus, and the liquid supply method can be used to manufacture a biochip, print an electronic circuit, or manufacture a semiconductor substrate. Further, since the application examples and the embodiments to be described below are detailed examples of the present invention, various technical limitations thereof can be made. However, the application examples and the embodiments are not limited to the application examples, the embodiments, or the other detailed methods of the specification and can be modified within the spirit of the present invention.

Hereinafter, appropriate application examples of the present invention will be described.

First Application Example (Description of Inkjet Printing Apparatus)

Figure 1:
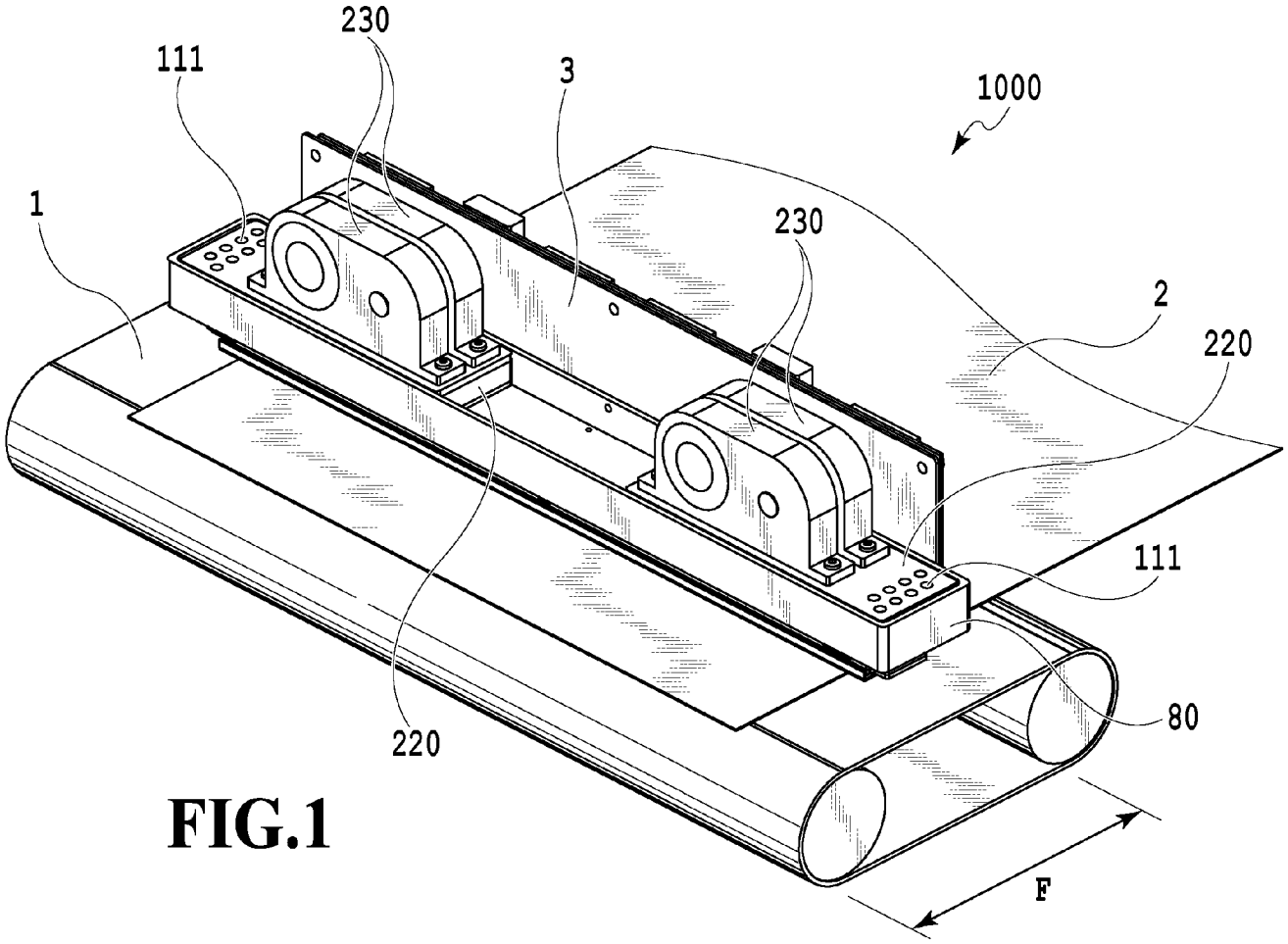
FIG. 1 is a diagram illustrating a schematic configuration of a liquid ejection apparatus that ejects a liquid.

FIG. 1 is a diagram illustrating a schematic configuration of a liquid ejection apparatus that ejects a liquid in the present invention and particularly an inkjet printing apparatus (hereinafter, also referred to as a printing apparatus) 1000 that prints an image by ejecting ink. The printing apparatus 1000 includes a conveying unit 1 which conveys a print medium 2 and a line type (page wide type) liquid ejection head 3 which is disposed to be substantially orthogonal to the conveying direction of the print medium 2. Then, the printing apparatus 1000 is a line type printing apparatus which continuously prints an image at one pass by ejecting ink onto the relative moving print mediums 2 while continuously or intermittently conveying the print mediums 2. The liquid ejection head 3 includes a negative pressure control unit 230 which controls a pressure (a negative pressure) inside a circulation path, a liquid supply unit 220 which communicates with the negative pressure control unit 230 so that a fluid can flow therebetween, a liquid connection portion 111 which serves as an ink supply opening and an ink discharge opening of the liquid supply unit 220, and a casing 80. The print medium 2 is not limited to a cut sheet and may be also a continuous roll medium. The liquid ejection head 3 can print a full color image by inks of cyan C, magenta M, yellow Y, and black K and is fluid-connected to a liquid supply member which serve as a supply path supplying a liquid to the liquid ejection head 3, a main tank, and a buffer tank (see FIG. 2 to be described later). Further, the control unit which supplies power and transmits an ejection control signal to the liquid ejection head 3 is electrically connected to the liquid ejection head 3. The liquid path and the electric signal path in the liquid ejection head 3 will be described later.

The printing apparatus 1000 is an inkjet printing apparatus that circulates a liquid such as ink between a tank to be described later and the liquid ejection head 3. The circulation configuration includes a first circulation configuration in which the liquid is circulated by the activation of two circulation pumps (for high and low pressures) at the downstream side of the liquid ejection head 3 and a second circulation configuration in which the liquid is circulated by the activation of two circulation pumps (for high and low pressures) at the upstream side of the liquid ejection head 3. Hereinafter, the first circulation configuration and the second circulation configuration of the circulation will be described.

(Description of First Circulation Configuration)

Figure 2:
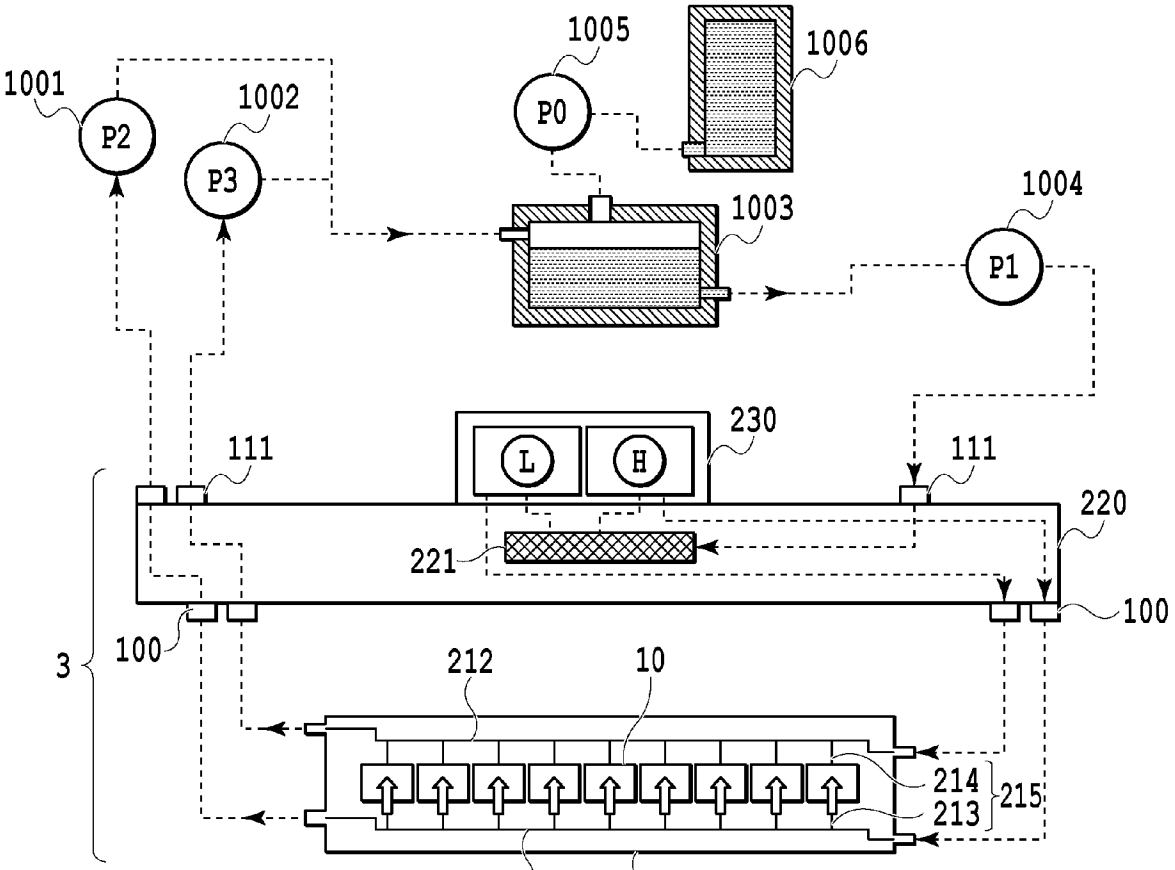
FIG. 2 is a schematic diagram illustrating a first circulation configuration in a circulation path applied to a printing apparatus.

FIG. 2 is a schematic diagram illustrating the first circulation configuration in the circulation path applied to the printing apparatus 1000 according to the embodiment. The liquid ejection head 3 is fluid-connected to a first circulation pump (the high pressure side) 1001, a first circulation pump (the low pressure side) 1002, and a buffer tank 1003. Further, in FIG. 2, in order to simplify a description, a path through which ink of one color of cyan C, magenta M, yellow Y, and black K flows is illustrated. However, in fact, four colors of circulation paths are provided in the liquid ejection head 3 and the printing apparatus body.

In the first circulation configuration, ink inside a main tank 1006 is supplied into the buffer tank 1003 by a replenishing pump 1005 and then is supplied to the liquid supply unit 220 of the liquid ejection head 3 through the liquid connection portion 111 by a second circulation pump 1004. Subsequently, the ink which is adjusted to two different negative pressures (high and low pressures) by the negative pressure control unit 230 connected to the liquid supply unit 220 is circulated while being divided into two passages having the high and low pressures. The ink inside the liquid ejection head 3 is circulated in the liquid ejection head by the action of the first circulation pump (the high pressure side) 1001 and the first circulation pump (the low pressure side) 1002 at the downstream side of the liquid ejection head 3, is discharged from the liquid ejection head 3 through the liquid connection portion 111, and is returned to the buffer tank 1003.

The buffer tank 1003 which is a sub-tank includes an atmosphere communication opening (not illustrated) which is connected to the main tank 1006 to communicate the inside of the tank with the outside and thus can discharge bubbles inside the ink to the outside. The replenishing pump 1005 is provided between the buffer tank 1003 and the main tank 1006. The replenishing pump 1005 delivers the ink from the main tank 1006 to the buffer tank 1003 after the ink is consumed by the ejection (the discharge) of the ink from the ejection opening of the liquid ejection head 3 in the printing operation and the suction recovery operation.

Two first circulation pumps 1001 and 1002 draw the liquid from the liquid connection portion 111 of the liquid ejection head 3 so that the liquid flows to the buffer tank 1003. As the first circulation pump, a displacement pump having quantitative liquid delivery ability is desirable. Specifically, a tube pump, a gear pump, a diaphragm pump, and a syringe pump can be exemplified. However, for example, a general constant flow valve or a general relief valve may be disposed at an outlet of a pump to ensure a predetermined flow rate. When the liquid ejection head 3 is driven, the first circulation pump (the high pressure side) 1001 and the first circulation pump (the low pressure side) 1002 are operated so that the ink flows at a predetermined flow rate through a common supply passage 211 and a common collection passage 212. Since the ink flows in this way, the temperature of the liquid ejection head 3 during a printing operation is kept at an optimal temperature. The predetermined flow rate when the liquid ejection head 3 is driven is desirably set to be equal to or higher than a flow rate at which a difference in temperature among the print element boards 10 inside the liquid ejection head 3 does not influence printing quality. Above all, in a case where a too high flow rate is set, a difference in negative pressure among the print element boards 10 increases due to the influence of pressure loss of the passage inside a liquid ejection unit 300 and thus unevenness in density is caused. For that reason, it is desirable to set the flow rate in consideration of a difference in temperature and a difference in negative pressure among the print element boards 10.

The negative pressure control unit 230 is provided in a path between the second circulation pump 1004 and the liquid ejection unit 300. The negative pressure control unit 230 is operated to keep a pressure at the downstream side (that is, a pressure near the liquid ejection unit 300) of the negative pressure control unit 230 at a predetermined pressure even in a case where the flow rate of the ink changes in the circulation system due to a difference in ejection amount per unit area. As two negative pressure control mechanisms constituting the negative pressure control unit 230, any mechanism may be used as long as a pressure at the downstream side of the negative pressure control unit 230 can be controlled within a predetermined range or less from a desired set pressure. As an example, a mechanism such as a so-called "pressure reduction regulator" can be employed. In the circulation passage of the application example, the upstream side of the negative pressure control unit 230 is pressurized by the second circulation pump 1004 through the liquid supply unit 220. With such a configuration, since an influence of a water head pressure of the buffer tank 1003 with respect to the liquid ejection head 3 can be suppressed, a degree of freedom in layout of the buffer tank 1003 of the printing apparatus 1000 can be widened.

As the second circulation pump 1004, a turbo pump or a displacement pump can be used as long as a predetermined head pressure or more can be exhibited in the range of the ink circulation flow rate used when the liquid ejection head 3 is driven. Specifically, a diaphragm pump can be used. Further, for example, a water head tank disposed to have a certain water head difference with respect to the negative pressure control unit 230 can be also used instead of the second circulation pump 1004. As illustrated in FIG. 2, the negative pressure control unit 230 includes two negative pressure adjustment mechanisms respectively having different control pressures. Among two negative pressure adjustment mechanisms, a relatively high pressure side (indicated by "H" in FIG. 2) and a relatively low pressure side (indicated by "L" in FIG. 2) are respectively connected to the common supply passage 211 and the common collection passage 212 inside the liquid ejection unit 300 through the liquid supply unit 220. The liquid ejection unit 300 is provided with the common supply passage 211, the common collection passage 212, and an individual passage 215 (an individual supply passage 213 and an individual collection passage 214) communicating with the print element board. The negative pressure control mechanism H is connected to the common supply passage 211, the negative pressure control mechanism L is connected to the common collection passage 212, and a differential pressure is formed between two common passages. Then, since the individual passage 215 communicates with the common supply passage 211 and the common collection passage 212, a flow (a flow indicated by an arrow direction of FIG. 2) is generated in which a part of the liquid flows from the common supply passage 211 to the common collection passage 212 through the passage formed inside the print element board 10.

In this way, the liquid ejection unit 300 has a flow in which a part of the liquid passes through the print element boards 10 while the liquid flows to pass through the common supply passage 211 and the common collection passage 212. For this reason, heat generated by the print element boards 10 can be discharged to the outside of the print element board 10 by the ink flowing through the common supply passage 211 and the common collection passage 212. With such a configuration, the flow of the ink can be generated even in the pressure chamber or the ejection opening not ejecting the liquid when an image is printed by the liquid ejection head 3. Accordingly, the thickening of the ink can be suppressed in such a manner that the viscosity of the ink thickened inside the ejection opening is decreased. Further, the thickened ink or the foreign material in the ink can be discharged toward the common collection passage 212. For this reason, the liquid ejection head 3 of the application example can print a high-quality image at a high speed.

(Description of Second Circulation Configuration)

Figure 3:
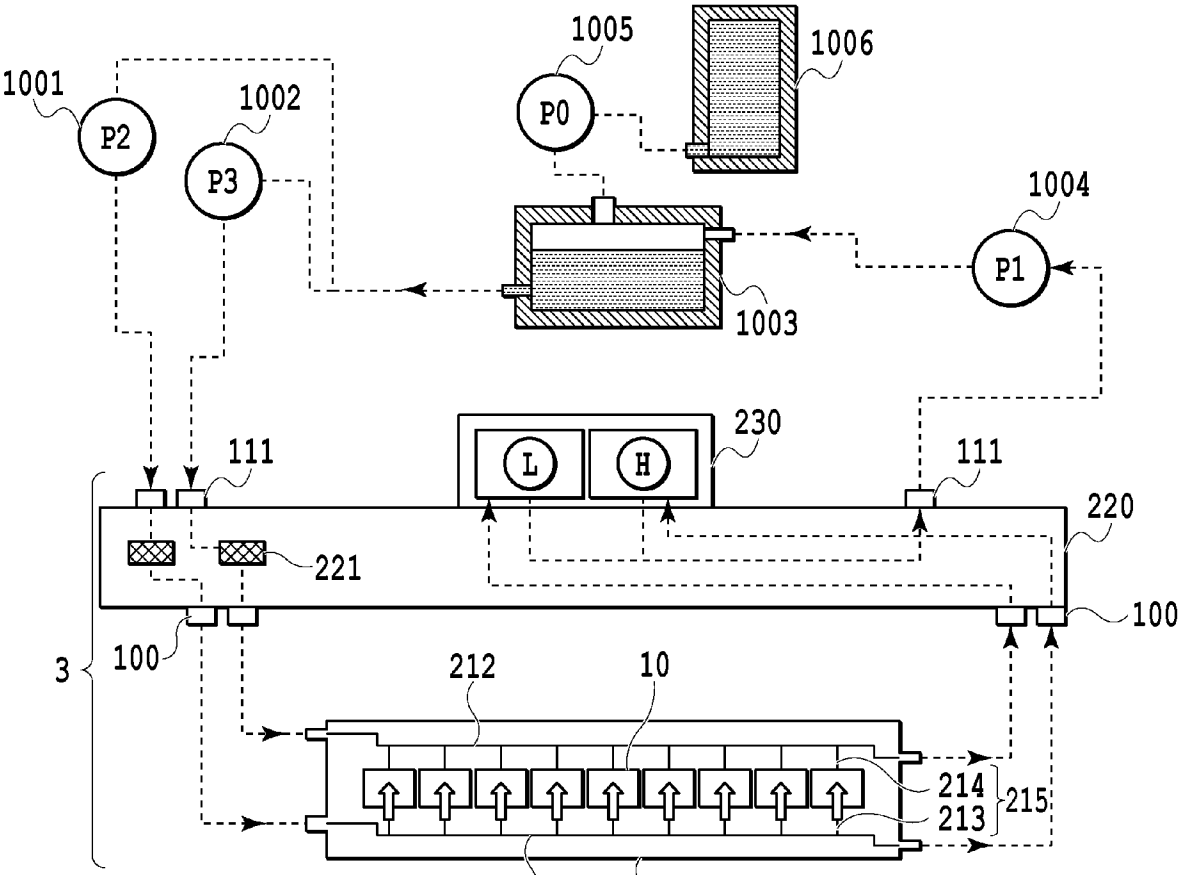
FIG. 3 is a schematic diagram illustrating a second circulation configuration in the circulation path applied to the printing apparatus.

FIG. 3 is a schematic diagram illustrating the second circulation configuration which is a circulation configuration different from the first circulation configuration in the circulation path applied to the printing apparatus of the application example. A main difference from the first circulation configuration is that two negative pressure control mechanisms constituting the negative pressure control unit 230 both control a pressure at the upstream side of the negative pressure control unit 230 within a predetermined range from a desired set pressure. Further, another difference from the first circulation configuration is that the second circulation pump 1004 serves as a negative pressure source which reduces a pressure at the downstream side of the negative pressure control unit 230. Further, still another difference is that the first circulation pump (the high pressure side) 1001 and the first circulation pump (the low pressure side) 1002 are disposed at the upstream side of the liquid ejection head 3 and the negative pressure control unit 230 is disposed at the downstream side of the liquid ejection head 3.

In the second circulation configuration, the ink inside the main tank 1006 is supplied to the buffer tank 1003 by the replenishing pump 1005. Subsequently, the ink is divided into two passages and is circulated in two passages at the high pressure side and the low pressure side by the action of the negative pressure control unit 230 provided in the liquid ejection head 3. The ink which is divided into two passages at the high pressure side and the low pressure side is supplied to the liquid ejection head 3 through the liquid connection portion 111 by the action of the first circulation pump (the high pressure side) 1001 and the first circulation pump (the low pressure side) 1002. Subsequently, the ink circulated inside the liquid ejection head by the action of the first circulation pump (the high pressure side) 1001 and the first circulation pump (the low pressure side) 1002 is discharged from the liquid ejection head 3 through the liquid connection portion 111 by the negative pressure control unit 230. The discharged ink is returned to the buffer tank 1003 by the second circulation pump 1004.

In the second circulation configuration, the negative pressure control unit 230 stabilizes a change in pressure at the upstream side (that is, the liquid ejection unit 300) of the negative pressure control unit 230 within a predetermined range from a predetermined pressure even in a case where a change in flow rate is caused by a change in ejection amount per unit area. In the circulation passage of the application example, the downstream side of the negative pressure control unit 230 is pressurized by the second circulation pump 1004 through the liquid supply unit 220. With such a configuration, since an influence of a water head pressure of the buffer tank 1003 with respect to the liquid ejection head 3 can be suppressed, the layout of the buffer tank 1003 in the printing apparatus 1000 can have many options. Instead of the second circulation pump 1004, for example, a water head tank disposed to have a predetermined water head difference with respect to the negative pressure control unit 230 can be also used. Similarly to the first circulation configuration, in the second circulation configuration, the negative pressure control unit 230 includes two negative pressure control mechanisms respectively having different control pressures. Among two negative pressure adjustment mechanisms, a high pressure side (indicated by "H" in FIG. 3) and a low pressure side (indicated by "L" in FIG. 3) are respectively connected to the common supply passage 211 or the common collection passage 212 inside the liquid ejection unit 300 through the liquid supply unit 220. In a case where the pressure of the common supply passage 211 is set to be higher than the pressure of the common collection passage 212 by two negative pressure adjustment mechanisms, a flow of the liquid is generated from the common supply passage 211 to the common collection passage 212 through the individual passage 215 and the passages formed inside the print element boards 10.

In such a second circulation configuration, the same liquid flow as that of the first circulation configuration can be obtained inside the liquid ejection unit 300, but has two advantages different from those of the first circulation configuration. As a first advantage, in the second circulation configuration, since the negative pressure control unit 230 is disposed at the downstream side of the liquid ejection head 3, there is low concern that a foreign material or a trash produced from the negative pressure control unit 230 flows into the liquid ejection head 3. As a second advantage, in the second circulation configuration, a maximal value of the flow rate necessary for the liquid from the buffer tank 1003 to the liquid ejection head 3 is smaller than that of the first circulation configuration. The reason is as below.

In the case of the circulation in the print standby state, the sum of the flow rates of the common supply passage 211 and the common collection passage 212 is set to a flow rate A. The value of the flow rate A is defined as a minimal flow rate necessary to adjust the temperature of the liquid ejection head 3 in the print standby state so that a difference in temperature inside the liquid ejection unit 300 falls within a desired range. Further, the ejection flow rate obtained in a case where the ink is ejected from all ejection openings of the liquid ejection unit 300 (the full ejection state) is defined as a flow rate F (the ejection amount per each ejection opening× the ejection frequency per unit time× the number of the ejection openings).

Figure 4:
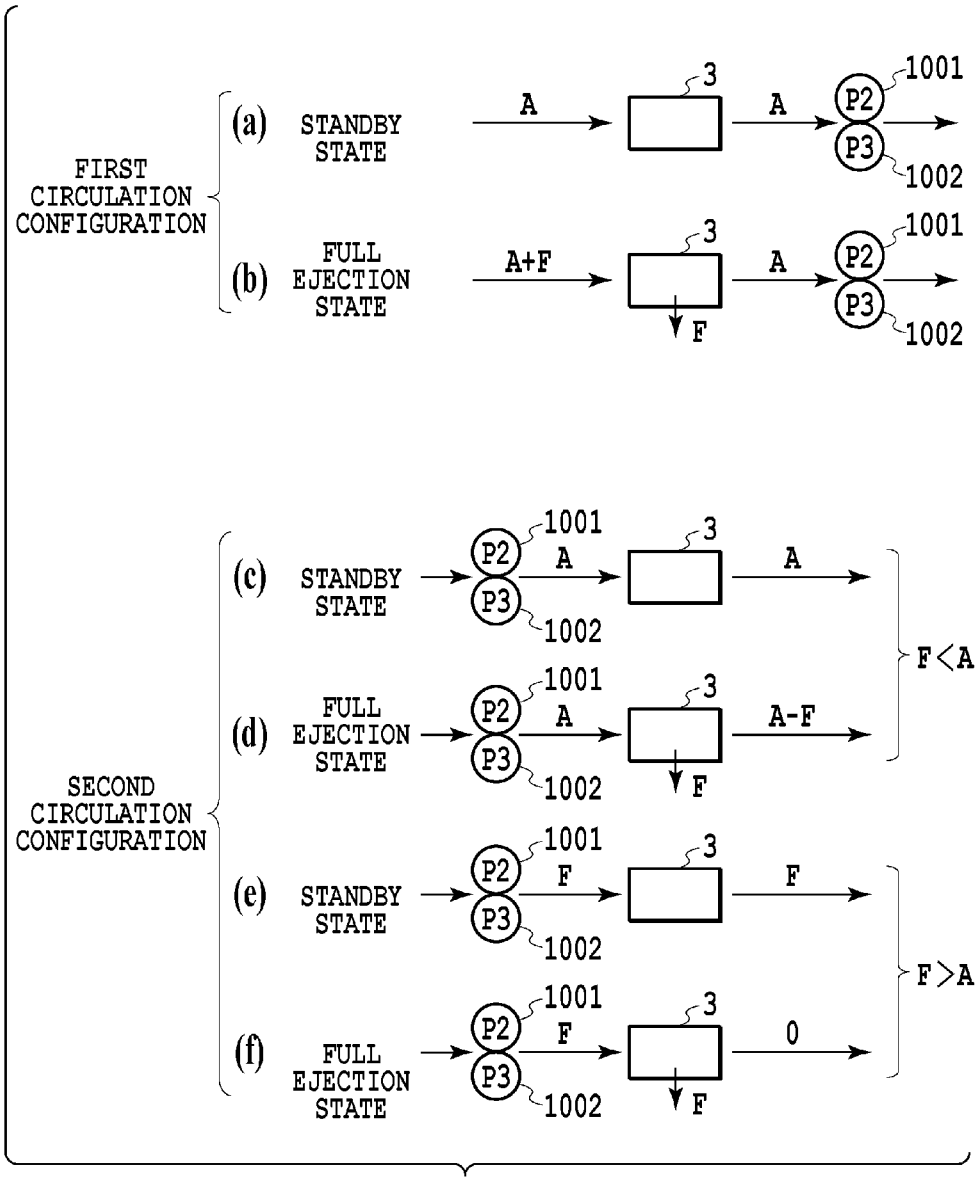
FIG. 4 is a schematic diagram illustrating a difference in ink inflow amount to a liquid ejection head.

FIG. 4 is a schematic diagram illustrating a difference in ink inflow amount to the liquid ejection head between the first circulation configuration and the second circulation configuration. Reference character (a) of FIG. 4 illustrates the standby state in the first circulation configuration and reference character (b) of FIG. 4 illustrates the full ejection state in the first circulation configuration. Reference characters (c) to (f) of FIG. 4 illustrate the second circulation passage. Here, reference characters (c) and (d) of FIG. 4 illustrate a case where the flow rate F is lower than the flow rate A and reference characters (e) and (f) of FIG. 4 illustrate a case where the flow rate F is higher than the flow rate A. In this way, the flow rates in the standby state and the full ejection state are illustrated.

In the case of the first circulation configuration (Reference characters (a) and (b) of FIG. 4) in which the first circulation pump 1001 and the first circulation pump 1002 each having a quantitative liquid delivery ability are disposed at the downstream side of the liquid ejection head 3, the total flow rate of the first circulation pump 1001 and the first circulation pump 1002 becomes the flow rate A. By the flow rate A, the temperature inside the liquid ejection unit 300 in the standby state can be managed. Then, in the case of the full ejection state of the liquid ejection head 3, the total flow rate of the first circulation pump 1001 and the first circulation pump 1002 becomes the flow rate A. However, a maximal flow rate of the liquid supplied to the liquid ejection head 3 is obtained such that the flow rate F consumed by the full ejection is added to the flow rate A of the total flow rate by the action of the negative pressure generated by the ejection of the liquid ejection head 3. Thus, a maximal value of the supply amount to the liquid ejection head 3 satisfies a relation of the flow rate A+the flow rate F since the flow rate F is added to the flow rate A (Reference character (b) of FIG. 4).

Meanwhile, in the case of the second circulation configuration (Reference characters (c) to (f) of FIG. 4) in which the first circulation pump 1001 and the first circulation pump 1002 are disposed at the upstream side of the liquid ejection head 3, the supply amount to the liquid ejection head 3 necessary for the print standby state becomes the flow rate A similarly to the first circulation configuration. Thus, in a case where the flow rate A is higher than the flow rate F (Reference characters (c) and (d) of FIG. 4) in the second circulation configuration in which the first circulation pump 1001 and the first circulation pump 1002 are disposed at the upstream side of the liquid ejection head 3, the supply amount to the liquid ejection head 3 sufficiently becomes the flow rate A even in the full ejection state. At that time, the discharge flow rate of the liquid ejection head 3 satisfies a relation of the flow rate A−the flow rate F (Reference character (d) of FIG. 4). However, in a case where the flow rate F is higher than the flow rate A (Reference characters (e) and (f) of FIG. 4), the flow rate becomes insufficient in a case where the flow rate of the liquid supplied to the liquid ejection head 3 becomes the flow rate A in the full ejection state. For that reason, in a case where the flow rate F is higher than the flow rate A, the supply amount to the liquid ejection head 3 needs to be set to the flow rate F. At that time, since the flow rate F is consumed by the liquid ejection head 3 in the full ejection state, the flow rate of the liquid discharged from the liquid ejection head 3 becomes almost zero (Reference character (f) of FIG. 4). In addition, if the liquid is not ejected in the full ejection state in a case where the flow rate F is higher than the flow rate A, the liquid which is attracted by the amount consumed by the ejection of the flow rate F is discharged from the liquid ejection head 3. Further, in a case where the flow rate A and the flow rate F are equal to each other, the flow rate A (or the flow rate F) is supplied to the liquid ejection head 3 and the flow rate F is consumed by the liquid ejection head 3. For this reason, the flow rate discharged from the liquid ejection head 3 becomes almost zero.

In this way, in the case of the second circulation configuration, the total value of the flow rates set for the first circulation pump 1001 and the first circulation pump 1002, that is, the maximal value of the necessary supply flow rate becomes a large value among the flow rate A and the flow rate F. For this reason, as long as the liquid ejection unit 300 having the same configuration is used, the maximal value (the flow rate A or the flow rate F) of the supply amount necessary for the second circulation configuration becomes smaller than the maximal value (the flow rate A+the flow rate F) of the supply flow rate necessary for the first circulation configuration.

For that reason, in the case of the second circulation configuration, the degree of freedom of the applicable circulation pump increases. For example, a circulation pump having a simple configuration and low cost can be used or a load of a cooler (not illustrated) provided in a main body side path can be reduced. Accordingly, there is an advantage that the cost of the printing apparatus can be decreased. This advantage is high in the line head having a relatively large value of the flow rate A or the flow rate F. Accordingly, a line head having a long longitudinal length among the line heads is beneficial.

Meanwhile, the first circulation configuration is more advantageous than the second circulation configuration. That is, in the second circulation configuration, since the flow rate of the liquid flowing through the liquid ejection unit 300 in the print standby state becomes maximal, a higher negative pressure is applied to the ejection openings as the ejection amount per unit area of the image (hereinafter, also referred to as a low-duty image) becomes smaller. For this reason, in a case where the passage width is narrow and the negative pressure is high, a high negative pressure is applied to the ejection opening in the low-duty image in which unevenness easily appears. Accordingly, there is concern that printing quality may be deteriorated in accordance with an increase in the number of so-called satellite droplets ejected along with main droplets of the ink.

Meanwhile, in the case of the first circulation configuration, since a high negative pressure is applied to the ejection opening when the image (hereinafter, also referred to as a high-duty image) having a large ejection amount per unit area is formed, there is an advantage that visibility of the satellite droplets is poor and an influence of the satellite droplets on the image is small even in a case where the satellite droplets are generated. Two circulation configurations can be desirably selected in consideration of the specifications (the ejection flow rate F, the minimal circulation flow rate A, and the passage resistance inside the head) of the liquid ejection head and the printing apparatus body.

(Description of Configuration of Liquid Ejection Head)

Figure 5A:
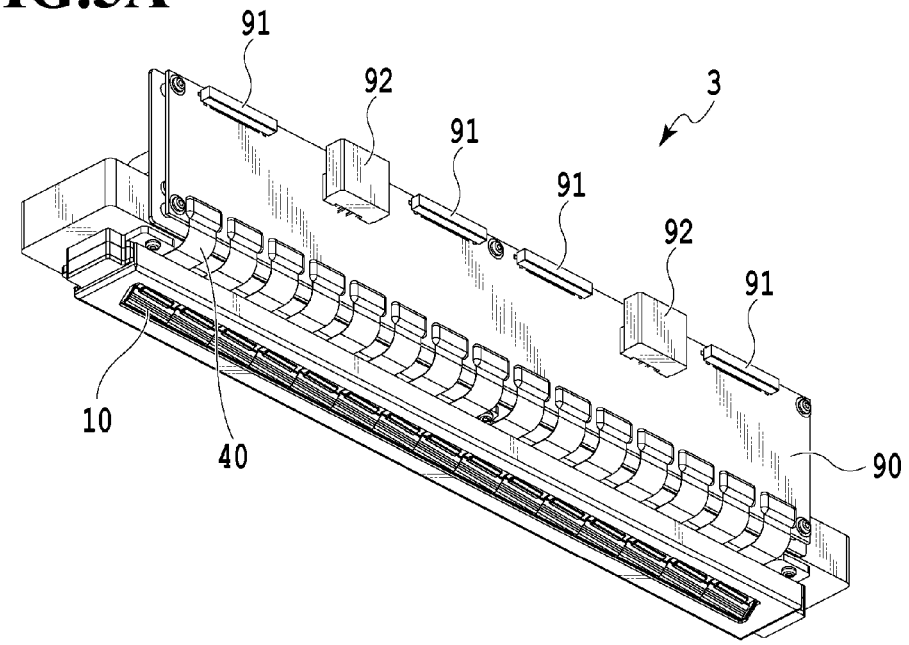
FIG. 5A is a perspective view illustrating the liquid ejection head.
Figure 5B:
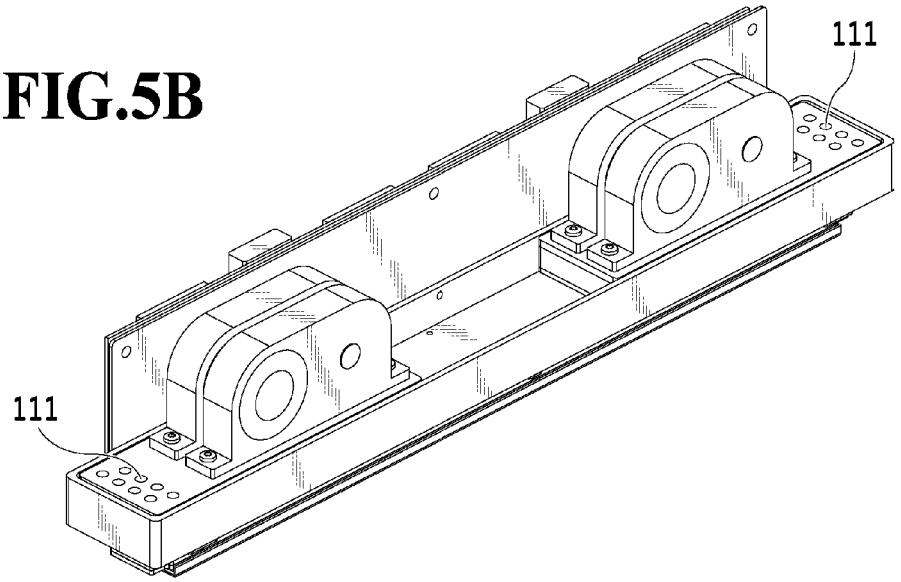
FIG. 5B is a perspective view illustrating the liquid ejection head.

A configuration of the liquid ejection head 3 according to the first application example will be described. FIGS. 5A and 5B are perspective views illustrating the liquid ejection head 3 according to the application example. The liquid ejection head 3 is a line type liquid ejection head in which fifteen print element boards 10 capable of ejecting inks of four colors of cyan C, magenta M, yellow Y, and black K are arranged in series on one print element board 10 (an in-line arrangement). As illustrated in FIG. 5A, the liquid ejection head 3 includes the print element boards 10 and a signal input terminal 91 and a power supply terminal 92 which are electrically connected to each other through a flexible circuit board 40 and an electric wiring board 90 capable of supplying electric energy to the print element board 10. The signal input terminal 91 and the power supply terminal 92 are electrically connected to the control unit of the printing apparatus 1000 so that an ejection drive signal and power necessary for the ejection are supplied to the print element board 10. In a case where the wirings are integrated by the electric circuit inside the electric wiring board 90, the number of the signal input terminals and the power supply terminals 92 can be decreased compared with the number of the print element boards 10. Accordingly, the number of electrical connection components to be separated when the liquid ejection head 3 is assembled to the printing apparatus 1000 or the liquid ejection head is replaced decreases. As illustrated in FIG. 5B, the liquid connection portions 111 which are provided at both ends of the liquid ejection head 3 are connected to the liquid supply system of the printing apparatus 1000. Accordingly, the inks of four colors including cyan C, magenta M, yellow Y, and black K4 are supplied from the supply system of the printing apparatus 1000 to the liquid ejection head 3 and the inks passing through the liquid ejection head 3 are collected by the supply system of the printing apparatus 1000. In this way, the inks of different colors can be circulated through the path of the printing apparatus 1000 and the path of the liquid ejection head 3.

Figure 6:
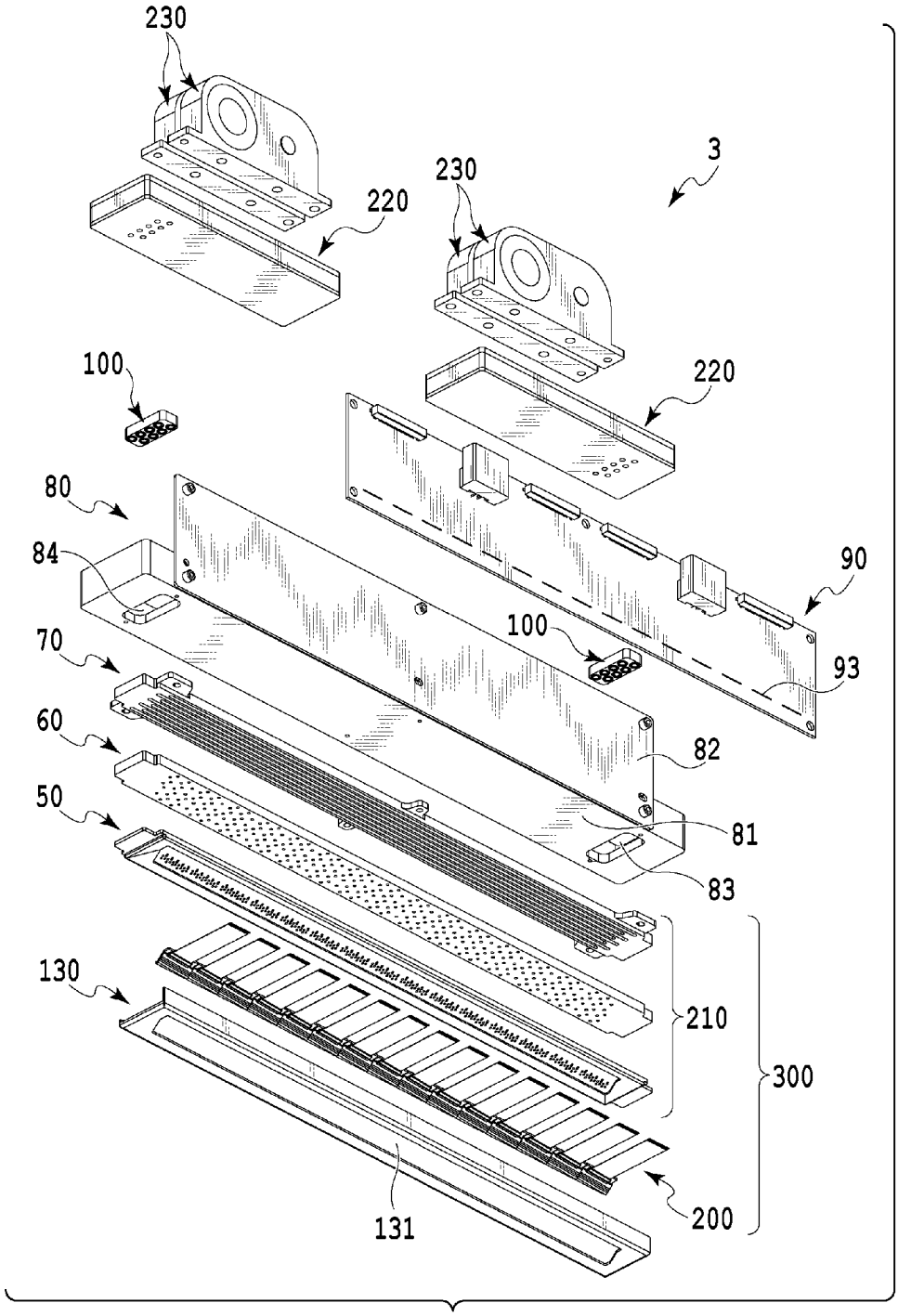
FIG. 6 is an exploded perspective view illustrating components or units constituting the liquid ejection head.

FIG. 6 is an exploded perspective view illustrating components or units constituting the liquid ejection head 3. The liquid ejection unit 300, the liquid supply unit 220, and the electric wiring board 90 are attached to the casing 80. The liquid connection portions 111 (see FIG. 3) are provided in the liquid supply unit 220. Also, in order to remove a foreign material in the supplied ink, filters 221 (see FIGS. 2 and 3) for different colors are provided inside the liquid supply unit 220 while communicating with the openings of the liquid connection portions 111. Two liquid supply units 220 respectively corresponding to two colors are provided with the filters 221. The liquid passing through the filter 221 is supplied to the negative pressure control unit 230 disposed on the liquid supply unit 220 disposed to correspond to each color. The negative pressure control unit 230 is a unit which includes different colors of negative pressure control valves. By the function of a spring member or a valve provided therein, a change in pressure loss inside the supply system (the supply system at the upstream side of the liquid ejection head 3) of the printing apparatus 1000 caused by a change in flow rate of the liquid is largely decreased. Accordingly, the negative pressure control unit 230 can stabilize a change negative pressure at the downstream side (the liquid ejection unit 300) of the negative pressure control unit within a predetermined range. As described in FIG. 2, two negative pressure control valves of different colors are built inside the negative pressure control unit 230. Two negative pressure control valves are respectively set to different control pressures. Here, the high pressure side communicates with the common supply passage 211 (see FIG. 2) inside the liquid ejection unit 300 and the low pressure side communicates with the common collection passage 212 (see FIG. 2) through the liquid supply unit 220.

The casing 80 includes a liquid ejection unit support portion 81 and an electric wiring board support portion 82 and ensures the rigidity of the liquid ejection head 3 while supporting the liquid ejection unit 300 and the electric wiring board 90. The electric wiring board support portion 82 is used to support the electric wiring board 90 and is fixed to the liquid ejection unit support portion 81 by a screw. The liquid ejection unit support portion 81 is used to correct the warpage or deformation of the liquid ejection unit 300 to ensure the relative position accuracy among the print element boards 10. Accordingly, stripe and unevenness of a printed medium is suppressed. For that reason, it is desirable that the liquid ejection unit support portion 81 have sufficient rigidity. As a material, metal such as SUS or aluminum or ceramic such as alumina is desirable. The liquid ejection unit support portion 81 is provided with openings 83 and 84 into which a joint rubber 100 is inserted. The liquid supplied from the liquid supply unit 220 is led to a third passage member 70 constituting the liquid ejection unit 300 through the joint rubber.

The liquid ejection unit 300 includes a plurality of ejection modules 200 and a passage member 210 and a cover member 130 is attached to a face near the print medium in the liquid ejection unit 300. Here, the cover member 130 is a member having a picture frame shaped surface and provided with an elongated opening 131 as illustrated in FIG. 6 and the print element board 10 and a sealing member 110 (see FIG. 10A to be described later) included in the ejection module 200 are exposed from the opening 131. A peripheral frame of the opening 131 serves as a contact face of a cap member that caps the liquid ejection head 3 in the print standby state. For this reason, it is desirable to form a closed space in a capping state by applying an adhesive, a sealing material, and a filling material along the periphery of the opening 131 to fill unevenness or a gap on the ejection opening face of the liquid ejection unit 300.

Next, a configuration of the passage member 210 included in the liquid ejection unit 300 will be described. As illustrated in FIG. 6, the passage member 210 is obtained by laminating a first passage member 50, a second passage member 60, and a third passage member 70 and distributes the liquid supplied from the liquid supply unit 220 to the ejection modules 200. Further, the passage member 210 is a passage member that returns the liquid re-circulated from the ejection module 200 to the liquid supply unit 220. The passage member 210 is fixed to the liquid ejection unit support portion 81 by a screw and thus the warpage or deformation of the passage member 210 is suppressed.

Figure 7:
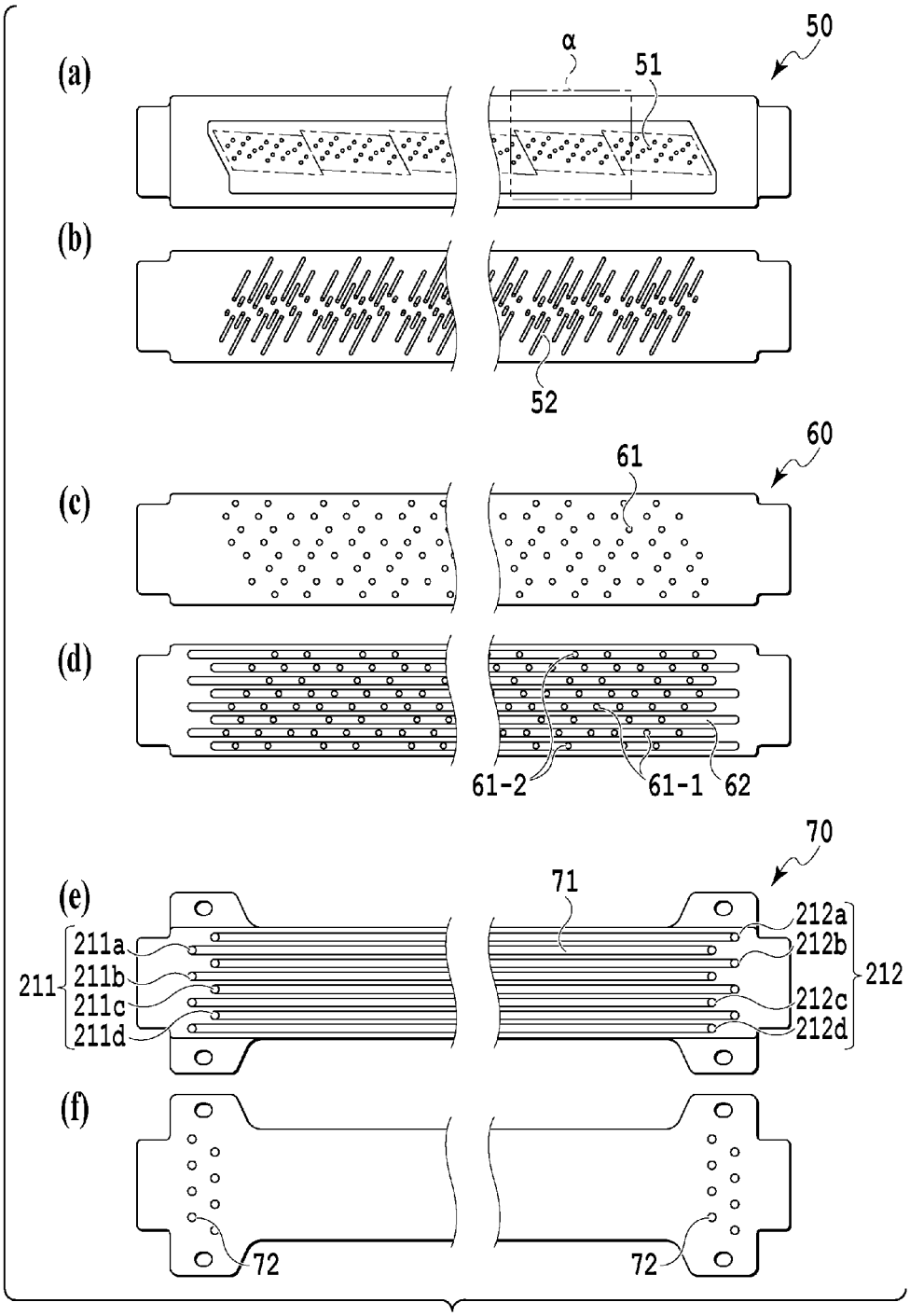
FIG. 7 is a diagram illustrating front and rear faces of first to third passage members.

FIG. 7 is a diagram illustrating front and rear faces of the first to third passage members. Reference character (a) of FIG. 7 illustrates a face onto which the ejection module 200 is mounted in the first passage member 50 and reference character (f) of FIG. 7 illustrates a face with which the liquid ejection unit support portion 81 comes into contact in the third passage member 70. The first passage member 50 and the second passage member 60 are bonded to each other so that the parts illustrated by reference characters (b) and (c) in FIG. 7 and corresponding to the contact faces of the passage members face each other and the second passage member and the third passage member are bonded to each other so that the parts illustrated by reference characters (d) and (e) of FIG. 7 and corresponding to the contact faces of the passage members face each other. In a case where the second passage member 60 and the third passage member 70 are bonded to each other, eight common passages (211*a*, 211*b*, 211*c*, 211*d*, 212*a*, 212*b*, 212*c*, 212*d*) extending in the longitudinal direction of the passage member are formed by common passage grooves 62 and 71 of the passage members. Accordingly, a set of the common supply passage 211 and the common collection passage 212 is formed inside the passage member 210 to correspond to each color. The ink is supplied from the common supply passage 211 to the liquid ejection head 3 and the ink supplied to the liquid ejection head 3 is collected by the common collection passage 212. A communication opening 72 (see reference character (f) of FIG. 7) of the third passage member 70 communicates with the holes of the joint rubber 100 and is fluid-connected to the liquid supply unit 220 (see FIG. 6). A bottom face of the common passage groove of the second passage member 60 is provided with a plurality of communication openings 61 (a communication opening 61-1 communicating with the common supply passage 211 and a communication opening 61-2 communicating with the common collection passage 212) and communicates with one end of an individual passage groove 52 of the first passage member 50. The other end of the individual passage groove of the first passage member 50 is provided with a communication opening 51 and is fluid-connected to the ejection modules 200 through the communication opening 51. By the individual passage groove 52, the passages can be densely provided at the center side of the passage member.

It is desirable that the first to third passage members be formed of a material having corrosion resistance with respect to a liquid and having a low linear expansion coefficient. As a material, for example, a composite material (resin) obtained by adding inorganic filler such as fiber or fine silica particles to a base material such as alumina, LCP (liquid crystal polymer), PPS (polyphenyl sulfide), or PSF (polysulfone) can be appropriately used. As a method of forming the passage member 210, three passage members may be laminated and adhered to one another. In a case where a resin composite material is selected as a material, a bonding method using welding may be used.

Figure 8:
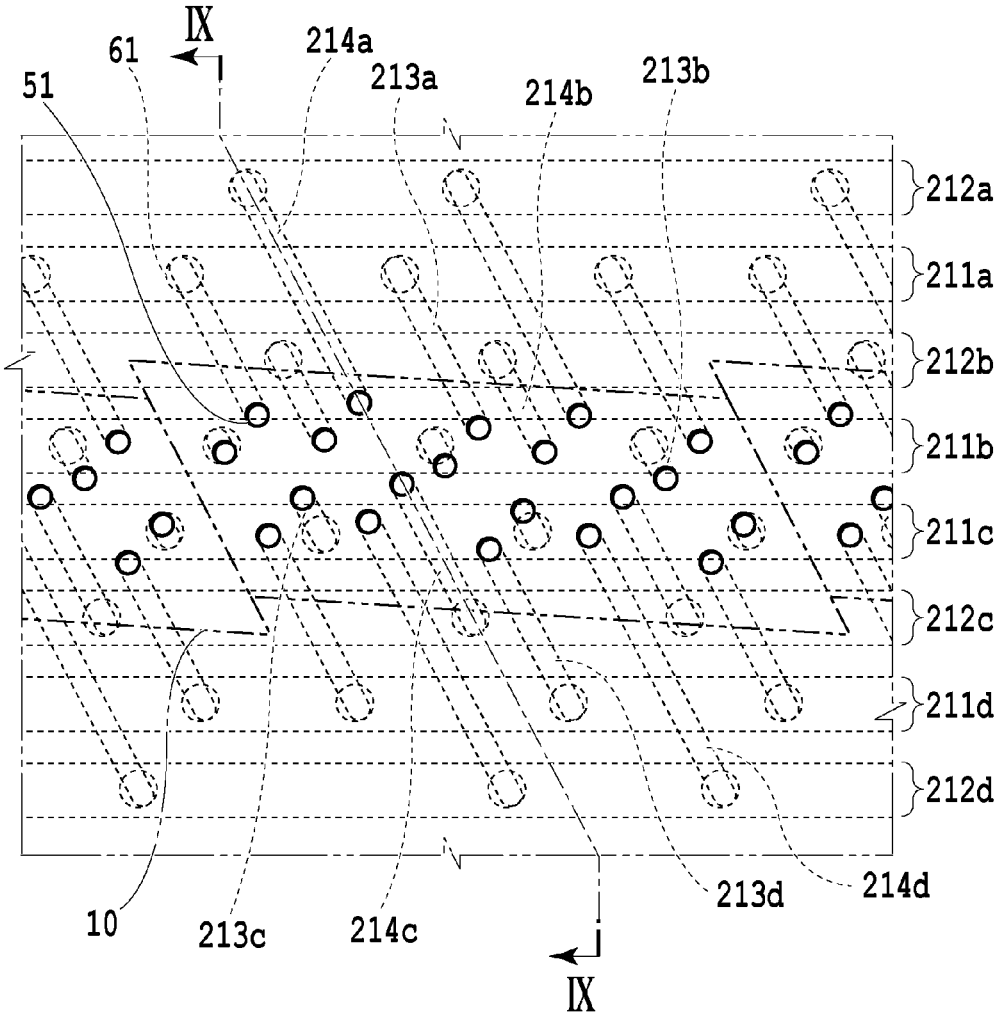
FIG. 8 is a perspective view illustrating a part a of FIG. 7 when viewed from an ejection module mounting face.

FIG. 8 is a partially enlarged perspective view illustrating a part a of FIG. 7 and illustrating the passages inside the passage member 210 formed by bonding the first to third passage members to one another when viewed from a face onto which the ejection module 200 is mounted in the first passage member 50. The common supply passage 211 and the common collection passage 212 are formed such that the common supply passage 211 and the common collection passage 212 are alternately disposed from the passages of both ends. Here, a connection relation among the passages inside the passage member 210 will be described.

The passage member 210 is provided with the common supply passage 211 (211*a*, 211*b*, 211*c*, 211*d*) and the common collection passage 212 (212*a*, 212*b*, 212*c*, 212*d*) extending in the longitudinal direction of the liquid ejection head 3 and provided for each color. The individual supply passages 213 (213*a*, 213*b*, 213*c*, 213*d*) which are formed by the individual passage grooves 52 are connected to the common supply passages 211 of different colors through the communication openings 61. Further, the individual collection passages 214 (214*a*, 214*b*, 214*c*, 214*d*) formed by the individual passage grooves 52 are connected to the common collection passages 212 of different colors through the communication openings 61. With such a passage configuration, the ink can be intensively supplied to the print element board 10 located at the center portion of the passage member from the common supply passages 211 through the individual supply passages 213. Further, the ink can be collected from the print element board 10 to the common collection passages 212 through the individual collection passages 214.

Figure 9:
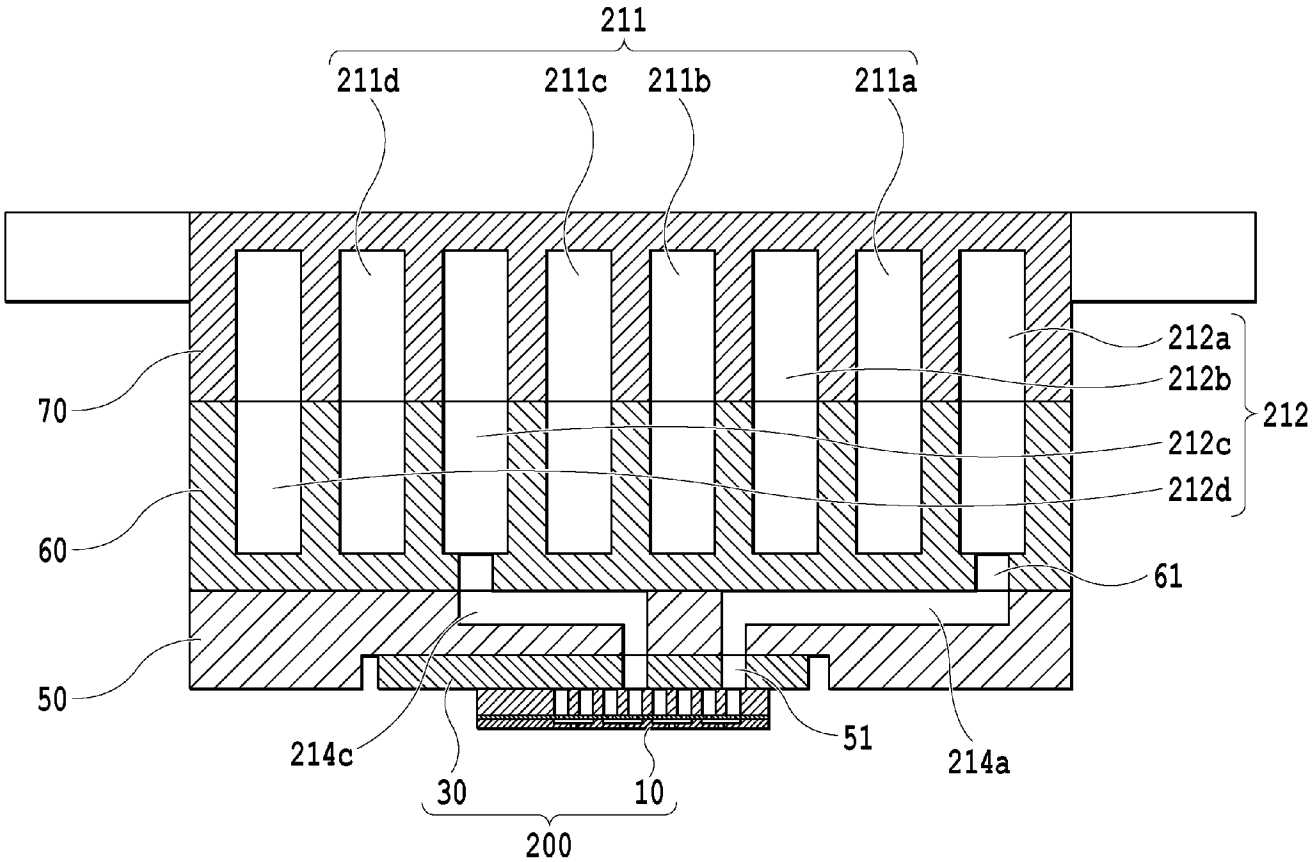
FIG. 9 is a cross-sectional view taken along a line IX-IX of FIG. 8.

FIG. 9 is a cross-sectional view taken along a line IX-IX of FIG. 8. The individual collection passage (214*a*, 214*c*) communicates with the ejection module 200 through the communication opening 51. In FIG. 9, only the individual collection passage (214*a*, 214*c*) is illustrated, but in a different cross-section, the individual supply passage 213 and the ejection module 200 communicates with each other as illustrated in FIG. 8. A support member 30 and the print element board 10 which are included in each ejection module 200 are provided with passages which supply the ink from the first passage member 50 to a print element 15 provided in the print element board 10. Further, the support member 30 and the print element board 10 are provided with passages which collect (re-circulate) a part or the entirety of the liquid supplied to the print element 15 to the first passage member 50.

Here, the common supply passage 211 of each color is connected to the negative pressure control unit 230 (the high pressure side) of corresponding color through the liquid supply unit 220 and the common collection passage 212 is connected to the negative pressure control unit 230 (the low pressure side) through the liquid supply unit 220. By the negative pressure control unit 230, a differential pressure (a difference in pressure) is generated between the common supply passage 211 and the common collection passage 212. For this reason, as illustrated in FIGS. 8 and 9, a flow is generated in order of the common supply passage 211 of each color, the individual supply passage 213, the print element board 10, the individual collection passage 214, and the common collection passage 212 inside the liquid ejection head of the application example having the passages connected to one another.

(Description of Ejection Module)

Figure 10A:
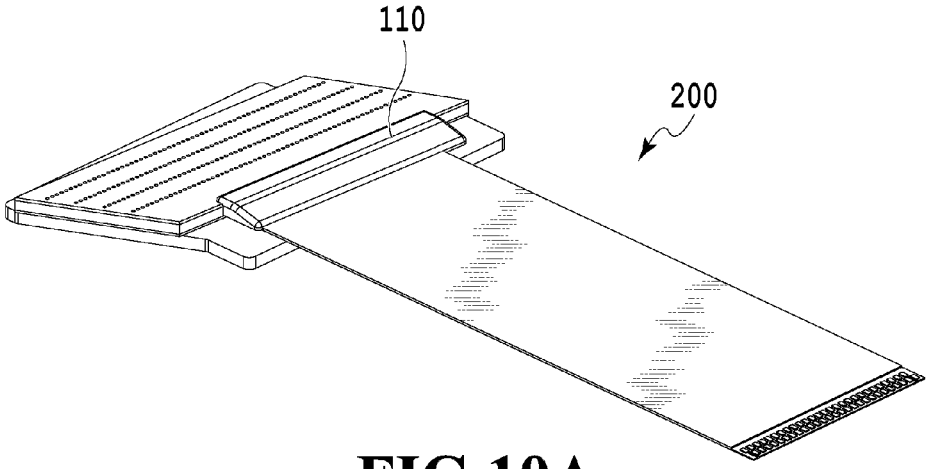
FIG. 10A is a perspective view illustrating one ejection module.
Figure 10B:
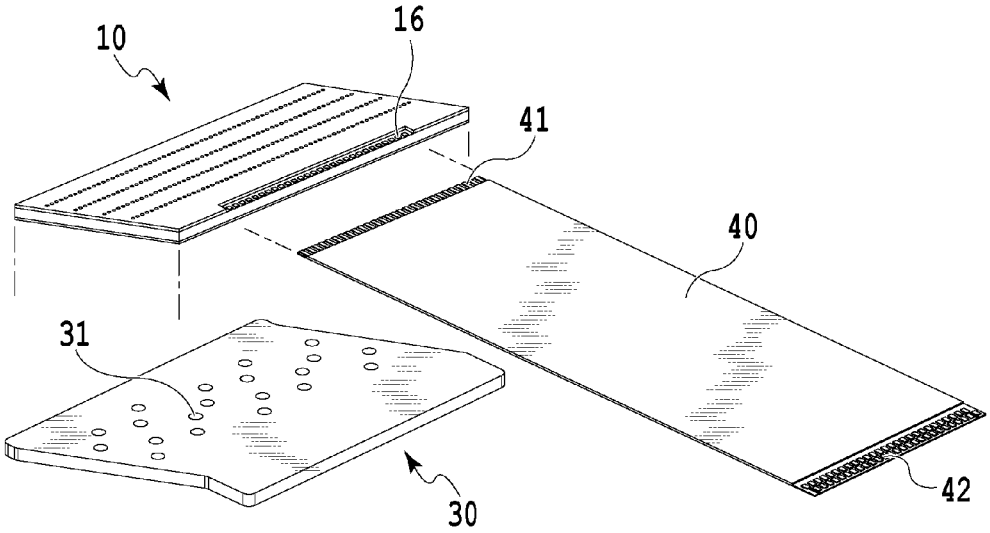
FIG. 10B is an exploded perspective view illustrating one ejection module.

FIG. 10A is a perspective view illustrating one ejection module 200 and FIG. 10B is an exploded view thereof. As a method of manufacturing the ejection module 200, first, the print element board 10 and the flexible circuit board 40 are adhered onto the support member 30 provided with a liquid communication opening 31. Subsequently, a terminal 16 on the print element board 10 and a terminal 41 on the flexible circuit board 40 are electrically connected to each other by wire bonding and the wire bonded portion (the electrical connection portion) is sealed by the sealing member 110. A terminal 42 which is opposite to the print element board 10 of the flexible circuit board 40 is electrically connected to a connection terminal 93 (see FIG. 6) of the electric wiring board 90. Since the support member 30 serves as a support body that supports the print element board 10 and a passage member that fluid-communicates the print element board 10 and the passage member 210 to each other, it is desirable that the support member have high flatness and sufficiently high reliability while being bonded to the print element board. As a material, for example, alumina or resin is desirable.

(Description of Structure of Print Element Board)

Figure 11A:
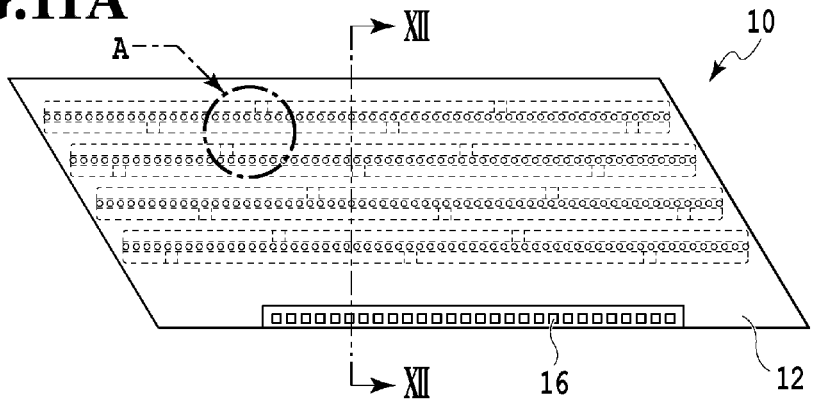
FIG. 11A is a diagram illustrating a print element board.
Figure 11B:
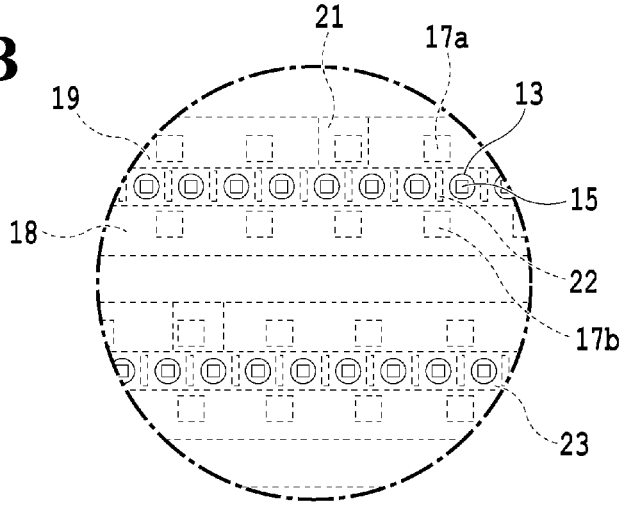
FIG. 11B is a diagram illustrating the print element board.
Figure 11C:
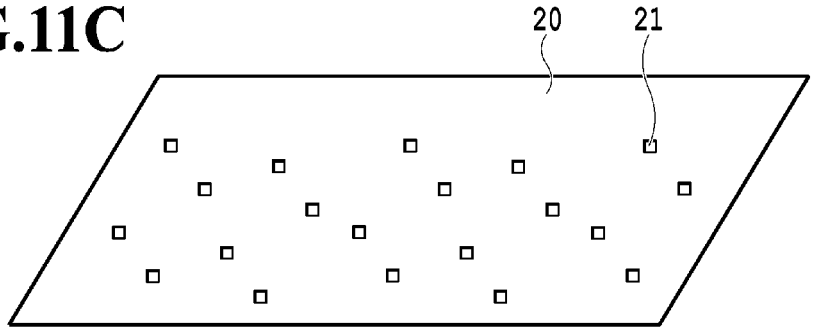
FIG. 11C is a diagram illustrating the print element board.

FIG. 11A is a top view illustrating a face provided with an ejection opening 13 in the print element board 10, FIG. 11B is an enlarged view of a part A of FIG. 11A, and FIG. 11C is a top view illustrating a rear face of FIG. 11A. Here, a configuration of the print element board of the application example will be described. As illustrated in FIG. 11A, an ejection opening forming member of the print element board 10 is provided with four ejection opening rows corresponding to different colors of inks. Further, the extension direction of the ejection opening rows of the ejection openings 13 will be referred to as an "ejection opening row direction". As illustrated in FIG. 11B, the print element 15 serving as a heater element for foaming the liquid by heat energy is disposed at a position corresponding to each ejection opening 13. A pressure chamber 23 provided inside the print element 15 is defined by a partition wall 22. The print element 15 is electrically connected to the terminal 16 by an electric wire (not illustrated) provided in the print element board 10. Then, the print element 15 boils the liquid while being heated on the basis of a pulse signal input from a control circuit of the printing apparatus 1000 via the electric wiring board 90 (see FIG. 6) and the flexible circuit board 40 (see FIG. 10B). The liquid is ejected from the ejection opening 13 by a foaming force caused by the boiling. As illustrated in FIG. 11B, a liquid supply path 18 extends at one side along each ejection opening row and a liquid collection path 19 extends at the other side along the ejection opening row. The liquid supply path 18 and the liquid collection path 19 are passages that extend in the ejection opening row direction provided in the print element board 10 and communicate with the ejection opening 13 through a supply opening 17*a* and a collection opening 17*b*.

As illustrated in FIG. 11C, a sheet-shaped lid member 20 is laminated on a rear face of a face provided with the ejection opening 13 in the print element board 10 and the lid member 20 is provided with a plurality of openings 21 communicating with the liquid supply path 18 and the liquid collection path 19. In the application example, the lid member 20 is provided with three openings 21 for each liquid supply path 18 and two openings 21 for each liquid collection path 19. As illustrated in FIG. 11B, openings 21 of the lid member 20 communicate with the communication openings 51 illustrated in FIG. 7(Reference character (a)). It is desirable that the lid member 20 have sufficient corrosion resistance for the liquid. From the viewpoint of preventing mixed color, the opening shape and the opening position of the opening 21 need to have high accuracy. For this reason, it is desirable to form the opening 21 by using a photosensitive resin material or a silicon plate as a material of the lid member 20 through photolithography. In this way, the lid member 20 changes the pitch of the passages by the opening 21. Here, it is desirable to form the lid member by a film-shaped member with a thin thickness in consideration of pressure loss.

Figure 12:
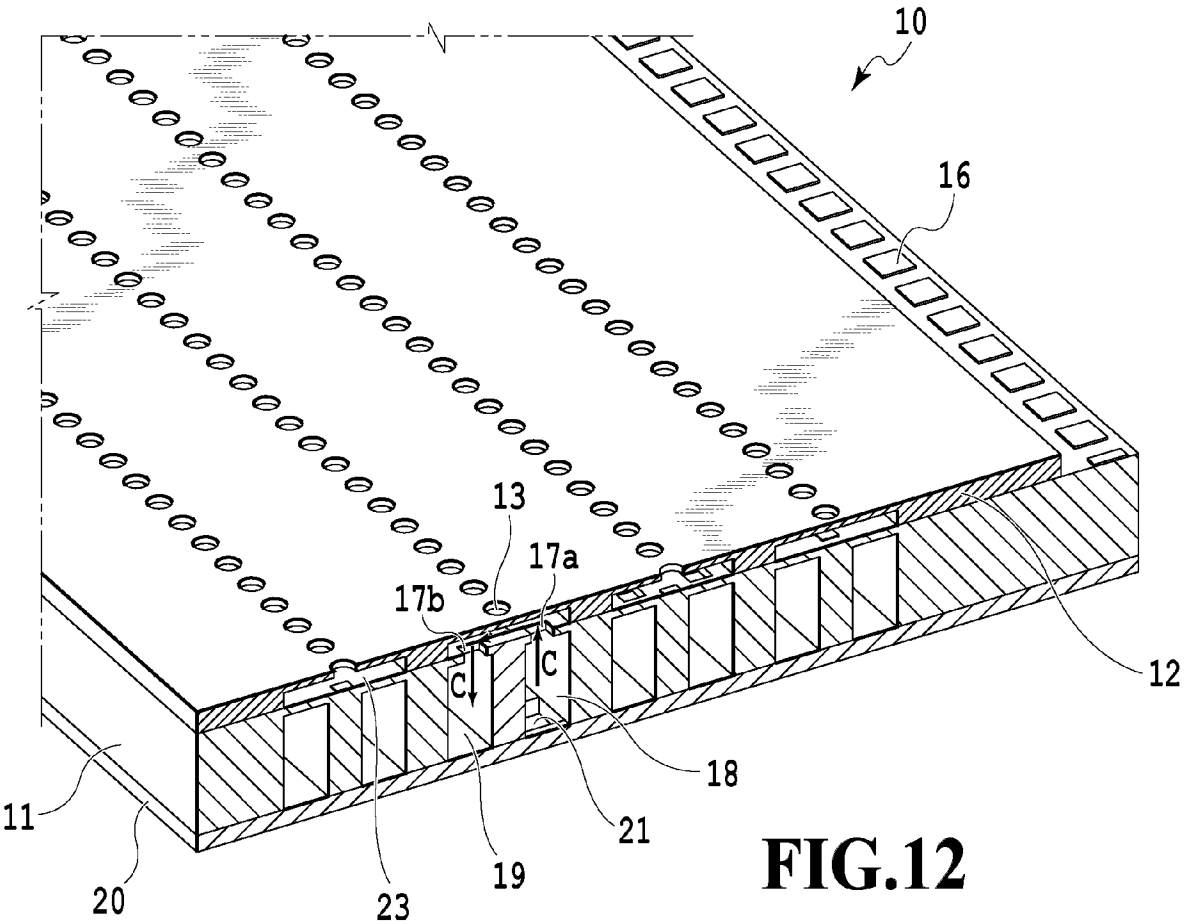
FIG. 12 is a perspective view illustrating cross-sections of the print element board and a lid member.

FIG. 12 is a perspective view illustrating cross-sections of the print element board 10 and the lid member 20 when taken along a line XII-XII of FIG. 11A. Here, a flow of the liquid inside the print element board 10 will be described. The lid member 20 serves as a lid that forms a part of walls of the liquid supply path 18 and the liquid collection path 19 formed in a substrate 11 of the print element board 10. The print element board 10 is formed by laminating the substrate 11 formed of Si and the ejection opening forming member 12 formed of photosensitive resin and the lid member 20 is bonded to a rear face of the substrate 11. One face of the substrate 11 is provided with the print element 15 (see FIG. 11B) and a rear face thereof is provided with grooves forming the liquid supply path 18 and the liquid collection path 19 extending along the ejection opening row. The liquid supply path 18 and the liquid collection path 19 which are formed by the substrate 11 and the lid member 20 are respectively connected to the common supply passage 211 and the common collection passage 212 inside each passage member 210 and a differential pressure is generated between the liquid supply path 18 and the liquid collection path 19. When the liquid is ejected from the ejection opening 13 to print an image, the liquid inside the liquid supply path 18 provided inside the substrate 11 at the ejection opening not ejecting the liquid flows toward the liquid collection path 19 through the supply opening 17*a*, the pressure chamber 23, and the collection opening 17*b* by the differential pressure (see an arrow C of FIG. 12). By the flow, foreign materials, bubbles, and thickened ink produced by the evaporation from the ejection opening 13 in the ejection opening 13 or the pressure chamber 23 not involved with a printing operation can be collected by the liquid collection path 19. Further, the thickening of the ink of the ejection opening 13 or the pressure chamber 23 can be suppressed. The liquid which is collected to the liquid collection path 19 is collected in order of the communication opening 51 (see FIG. 7) inside the passage member 210, the individual collection passage 214, and the common collection passage 212 through the opening 21 of the lid member 20 and the liquid communication opening 31 (see FIG. 10B) of the support member 30. Then, the liquid is collected by the collection path of the printing apparatus 1000. That is, the liquid supplied from the printing apparatus body to the liquid ejection head 3 flows in the following order to be supplied and collected.

First, the liquid flows from the liquid connection portion 111 of the liquid supply unit 220 into the liquid ejection head 3. Then, the liquid is sequentially supplied through the joint rubber 100, the communication opening 72 and the common passage groove 71 provided in the third passage member, the common passage groove 62 and the communication opening 61 provided in the second passage member, and the individual passage groove 52 and the communication opening 51 provided in the first passage member. Subsequently, the liquid is supplied to the pressure chamber 23 while sequentially passing through the liquid communication opening 31 provided in the support member 30, the opening 21 provided in the lid member 20, and the liquid supply path 18 and the supply opening 17*a* provided in the substrate 11. In the liquid supplied to the pressure chamber 23, the liquid which is not ejected from the ejection opening 13 sequentially flows through the collection opening 17*b* and the liquid collection path 19 provided in the substrate 11, the opening 21 provided in the lid member 20, and the liquid communication opening 31 provided in the support member 30. Subsequently, the liquid sequentially flows through the communication opening and the individual passage groove 52 provided in the first passage member, the communication opening 61 and the common passage groove 62 provided in the second passage member, the common passage groove 71 and the communication opening 72 provided in the third passage member 70, and the joint rubber 100. Then, the liquid flows from the liquid connection portion 111 provided in the liquid supply unit 220 to the outside of the liquid ejection head 3.

In the first circulation configuration illustrated in FIG. 2, the liquid which flows from the liquid connection portion 111 is supplied to the joint rubber 100 through the negative pressure control unit 230. Further, in the second circulation configuration illustrated in FIG. 3, the liquid which is collected from the pressure chamber 23 passes through the joint rubber 100 and flows from the liquid connection portion 111 to the outside of the liquid ejection head through the negative pressure control unit 230. The entire liquid which flows from one end of the common supply passage 211 of the liquid ejection unit 300 is not supplied to the pressure chamber 23 through the individual supply passage 213*a*. That is, the liquid may flow from the other end of the common supply passage 211 to the liquid supply unit 220 while not flowing into the individual supply passage 213*a* by the liquid which flows from one end of the common supply passage 211. In this way, since the path is provided so that the liquid flows therethrough without passing through the print element board 10, the reverse flow of the circulation flow of the liquid can be suppressed even in the print element board 10 including the small passage with a large flow resistance as in the application example. In this way, since the thickening of the liquid in the vicinity of the ejection opening or the pressure chamber 23 can be suppressed in the liquid ejection head 3 of the application example, a slippage or a non-ejection can be suppressed. As a result, a high-quality image can be printed.

(Description of Positional Relation Among Print Element Boards)

Figure 13:
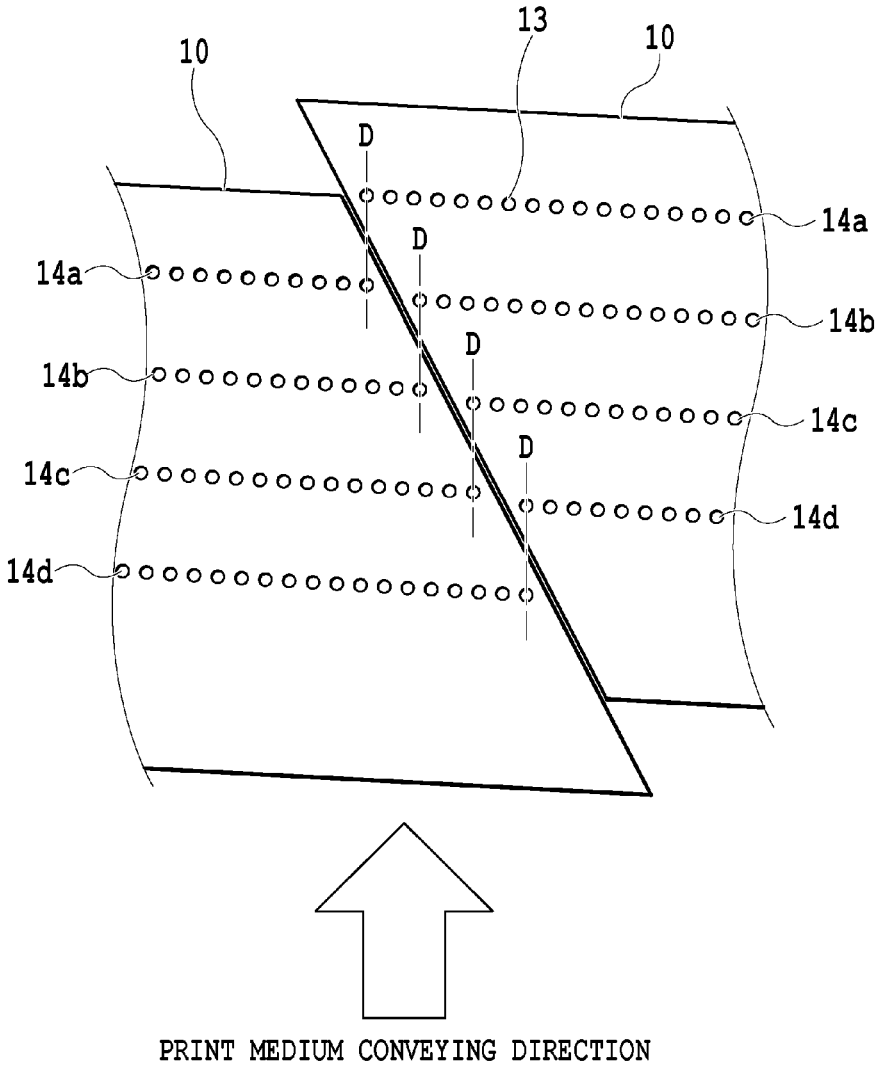
FIG. 13 is a partially enlarged top view of an adjacent portion of the print element board.

FIG. 13 is a partially enlarged top view illustrating an adjacent portion of the print element board in two adjacent ejection modules. In the application example, a substantially parallelogram print element board is used. Ejection opening rows (14*a* to 14*d*) having the ejection openings 13 arranged in each print element board 10 are disposed to be inclined while having a predetermined angle with respect to the longitudinal direction of the liquid ejection head 3. Then, the ejection opening row at the adjacent portion between the print element boards 10 is formed such that at least one ejection opening overlaps in the print medium conveying direction. In FIG. 13, two ejection openings on a line D overlap each other. With such an arrangement, even in a case where a position of the print element board 10 is slightly deviated from a predetermined position, black streaks or voids of a print image cannot be seen by a driving control of the overlapping ejection openings. Even in a case where the print element boards 10 are disposed in a straight linear shape (an in-line shape) instead of a zigzag shape, black streaks or voids at the connection portion between the print element boards 10 can be handled while an increase in the length of the liquid ejection head 3 in the print medium conveying direction is suppressed by the configuration illustrated in FIG. 13. Further, in the application example, a principal plane of the print element board has a parallelogram shape, but the invention is not limited thereto. For example, even in a case where the print element boards having a rectangular shape, a trapezoid shape, and the other shapes are used, the configuration of the invention can be desirably used.

Second Application Example

Hereinafter, configurations of an inkjet printing apparatus 2000 and a liquid ejection head 2003 according to a second application example of the invention will be described with reference to the drawings. In the description below, only a difference from the first application example will be described and a description of the same components as those of the first application example will be omitted.

(Description of Inkjet Printing Apparatus)

Figure 21:
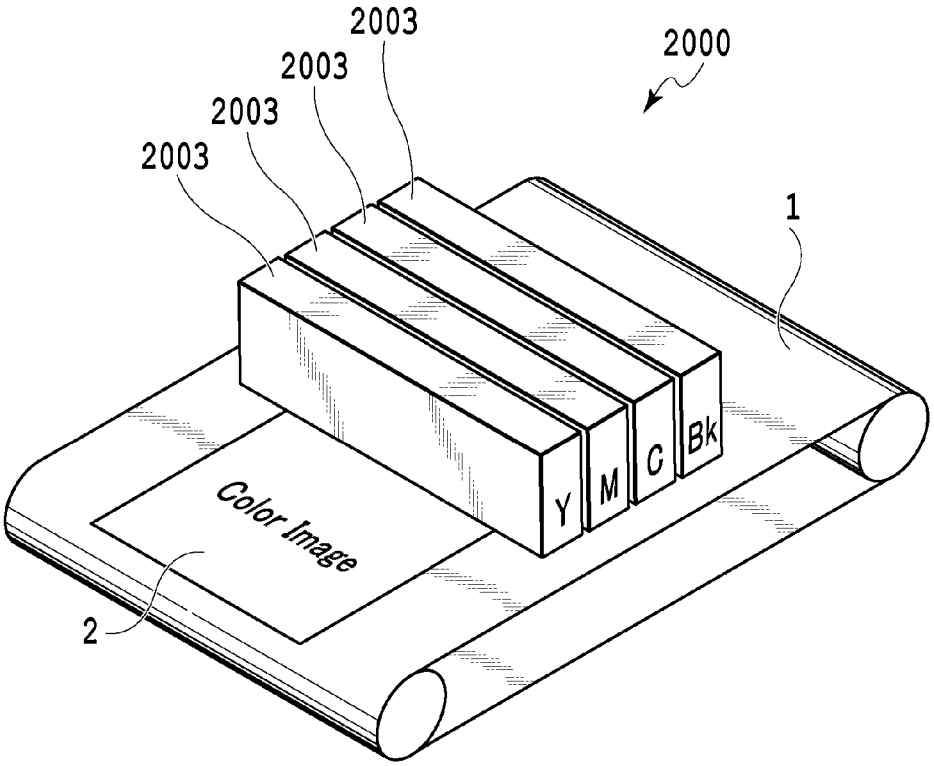
FIG. 21 is a diagram illustrating an inkjet printing apparatus that prints an image by ejecting a liquid.

FIG. 21 is a diagram illustrating the inkjet printing apparatus 2000 according to the application example used to eject the liquid. The printing apparatus 2000 of the application example is different from the first application example in that a full color image is printed on the print medium by a configuration in which four monochromic liquid ejection heads 2003 respectively corresponding to the inks of cyan C, magenta M, yellow Y, and black K are disposed in parallel. In the first application example, the number of the ejection opening rows which can be used for one color is one. However, in the application example, the number of the ejection opening rows which can be used for one color is twenty. For this reason, in a case where print data is appropriately distributed to a plurality of ejection opening rows to print an image, an image can be printed at a higher speed. Further, even in a case where there are the ejection openings that do not eject the liquid, the liquid is ejected complementarily from the ejection openings of the other rows located at positions corresponding to the non-ejection openings in the print medium conveying direction. The reliability is improved and thus a commercial image can be appropriately printed. Similarly to the first application example, the supply system, the buffer tank 1003 (see FIGS. 2 and 3), and the main tank 1006 (see FIGS. 2 and 3) of the printing apparatus 2000 are fluid-connected to the liquid ejection heads 2003. Further, an electrical control unit which transmits power and ejection control signals to the liquid ejection head 2003 is electrically connected to the liquid ejection heads 2003.

(Description of Circulation Path)

Similarly to the first application example, the first and second circulation configurations illustrated in FIG. 2 or 3 can be used as the liquid circulation configuration between the printing apparatus 2000 and the liquid ejection head 2003.

(Description of Structure of Liquid Ejection Head)

Figure 14A:
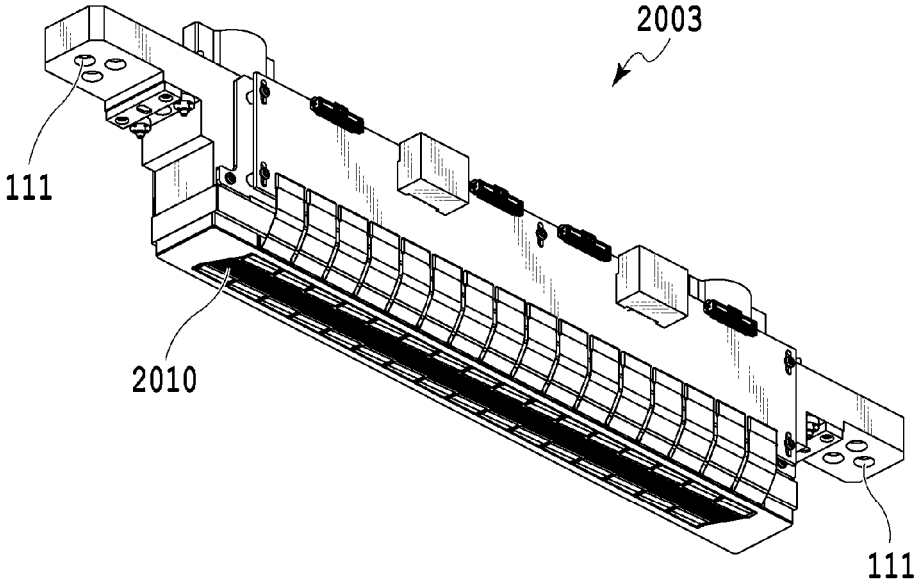
FIG. 14A is a perspective view illustrating the liquid ejection head.
Figure 14B:
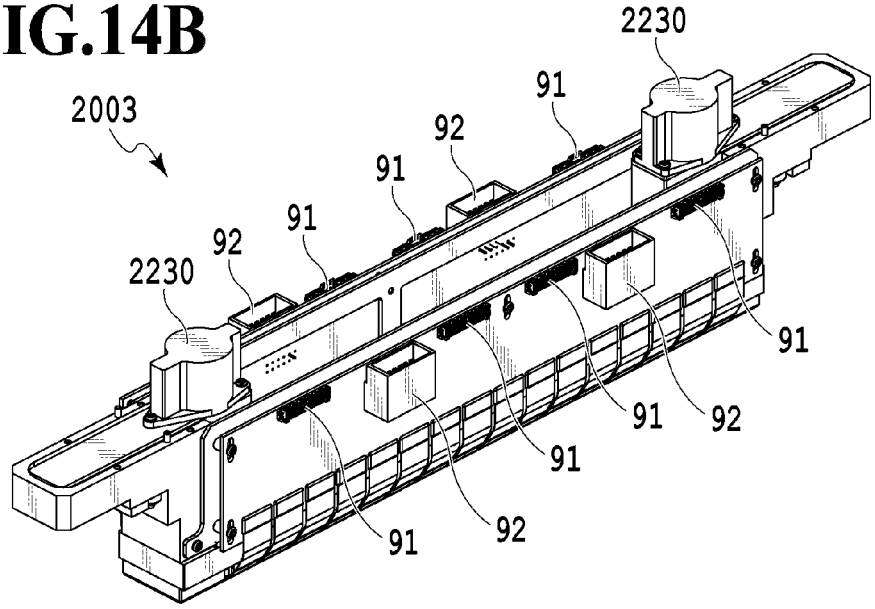
FIG. 14B is a perspective view illustrating the liquid ejection head.

FIGS. 14A and 14B are perspective views illustrating the liquid ejection head 2003 according to the application example. Here, a structure of the liquid ejection head 2003 according to the application example will be described. The liquid ejection head 2003 is an inkjet line type (page wide type) print head which includes sixteen print element boards 2010 arranged linearly in the longitudinal direction of the liquid ejection head 2003 and can print an image by one kind of liquid. Similarly to the first application example, the liquid ejection head 2003 includes the liquid connection portion 111, the signal input terminal 91, and the power supply terminal 92. However, since the liquid ejection head 2003 of the application example includes many ejection opening rows compared with the first application example, the signal input terminal 91 and the power supply terminal 92 are disposed at both sides of the liquid ejection head 2003. This is because a decrease in voltage or a delay in transmission of a signal caused by the wiring portion provided in the print element board 2010 needs to be reduced.

Figure 15:
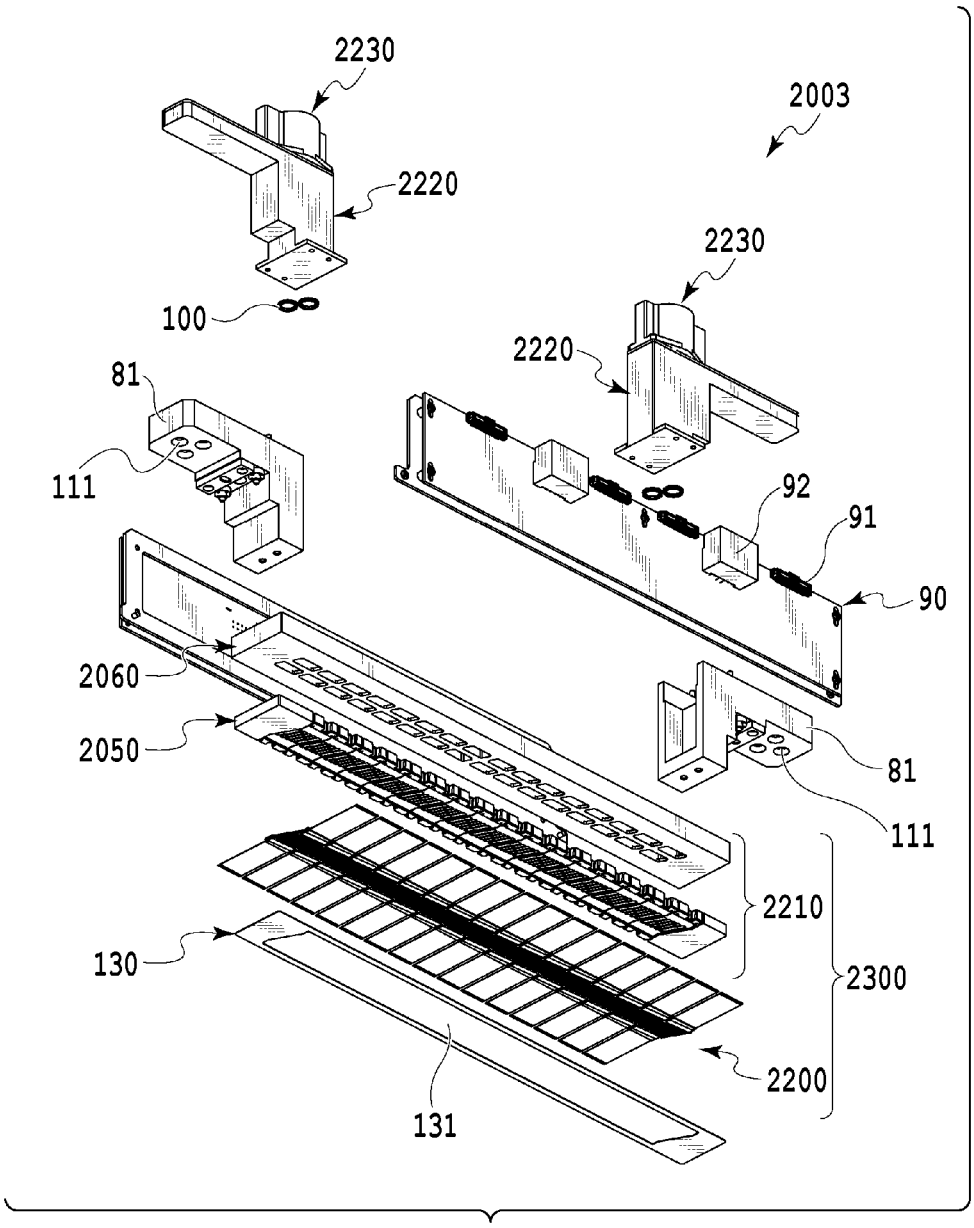
FIG. 15 is an exploded perspective view illustrating the liquid ejection head.

FIG. 15 is an exploded perspective view illustrating the liquid ejection head 2003 and components or units constituting the liquid ejection head 2003 according to the functions thereof. The function of each of units and members or the liquid flow sequence inside the liquid ejection head is basically similar to that of the first application example, but the function of guaranteeing the rigidity of the liquid ejection head is different. In the first application example, the rigidity of the liquid ejection head is mainly guaranteed by the liquid ejection unit support portion 81, but in the liquid ejection head 2003 of the second application example, the rigidity of the liquid ejection head is guaranteed by a second passage member 2060 included in a liquid ejection unit 2300. The liquid ejection unit support portion 81 of the application example is connected to both ends of the second passage member 2060 and the liquid ejection unit 2300 is mechanically connected to a carriage of the printing apparatus 2000 to position the liquid ejection head 2003. The electric wiring board 90 and a liquid supply unit 2220 including a negative pressure control unit 2230 are connected to the liquid ejection unit support portion 81. Each of two liquid supply units 2220 includes a filter (not illustrated) built therein.

Two negative pressure control units 2230 are set to control a pressure at different and relatively high and low negative pressures. Further, as in FIGS. 14B and 15, in a case where the negative pressure control units 2230 at the high pressure side and the low pressure side are provided at both ends of the liquid ejection head 2003, the flows of the liquid in the common supply passage and the common collection passage extending in the longitudinal direction of the liquid ejection head 2003 face each other. In such a configuration, a heat exchange between the common supply passage and the common collection passage is promoted and thus a difference in temperature inside two common passages is reduced. Accordingly, a difference in temperature of the print element boards 2010 provided along the common passage is reduced. As a result, there is an advantage that unevenness in printing is not easily caused by a difference in temperature.

Next, a detailed configuration of a passage member 2210 of the liquid ejection unit 2300 will be described. As illustrated in FIG. 15, the passage member 2210 is obtained by laminating a first passage member 2050 and a second passage member 2060 and distributes the liquid supplied from the liquid supply unit 2220 to ejection modules 2200. The passage member 2210 serves as a passage member that returns the liquid re-circulated from the ejection module 2200 to the liquid supply unit 2220. The second passage member 2060 of the passage member 2210 is a passage member having a common supply passage and a common collection passage formed therein and improving the rigidity of the liquid ejection head 2003. For this reason, it is desirable that a material of the second passage member 2060 have sufficient corrosion resistance for the liquid and high mechanical strength. Specifically, SUS, Ti, or alumina can be used.

Figure 16:
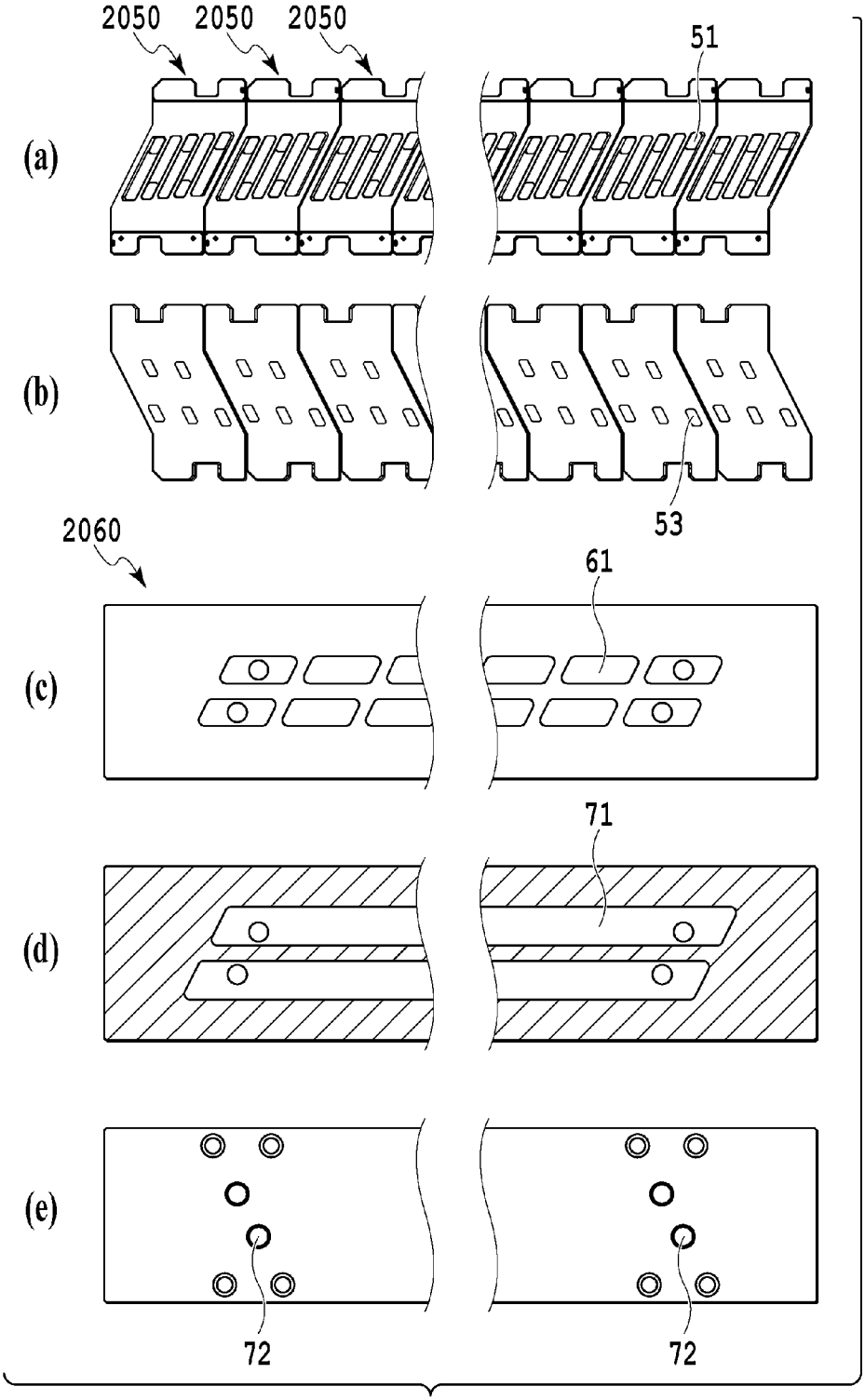
FIG. 16 is a diagram illustrating the first passage member.

Reference character (a) of FIG. 16 illustrates a face onto which the ejection module 2200 is mounted in the first passage member 2050 and reference character (b) of FIG. 16 illustrates a rear face thereof and a face contacting the second passage member 2060. Differently from the first application example, the first passage member 2050 of the application example has a configuration in which a plurality of members are disposed adjacently to respectively correspond to the ejection modules 2200. By employing such a split structure, a plurality of modules can be arranged to correspond to a length of the liquid ejection head 2003. Accordingly, this structure can be appropriately used particularly in a relatively long liquid ejection head corresponding to, for example, a sheet having a size of B2 or more. As illustrated in FIG. 16 (Reference character (a)), the communication opening 51 of the first passage member 2050 fluid-communicates with the ejection module 2200. As illustrated in FIG. 16 (Reference character (b)), the individual communication opening 53 of the first passage member 2050 fluid-communicates with the communication opening 61 of the second passage member 2060. Reference character (c) of FIG. 16 illustrates a contact face of the second passage member 2060 with respect to the first passage member 2050, reference character (d) of FIG. 16 illustrates a cross-section of a center portion of the second passage member 2060 in the thickness direction, and reference character (e) of FIG. 16 illustrates a contact face of the second passage member 2060 with respect to the liquid supply unit 2220. The function of the communication opening or the passage of the second passage member 2060 is similar to each color of the first application example. The common passage groove 71 of the second passage member 2060 is formed such that one side thereof is a common supply passage 2211 illustrated in FIG. 17 and the other side thereof is a common collection passage 2212. These passages are respectively provided along the longitudinal direction of the liquid ejection head 2003 so that the liquid is supplied from one end thereof to the other end thereof. The application example is different from the first application example in that the liquid flow directions in the common supply passage 2211 and the common collection passage 2212 are opposite to each other.

Figure 17:
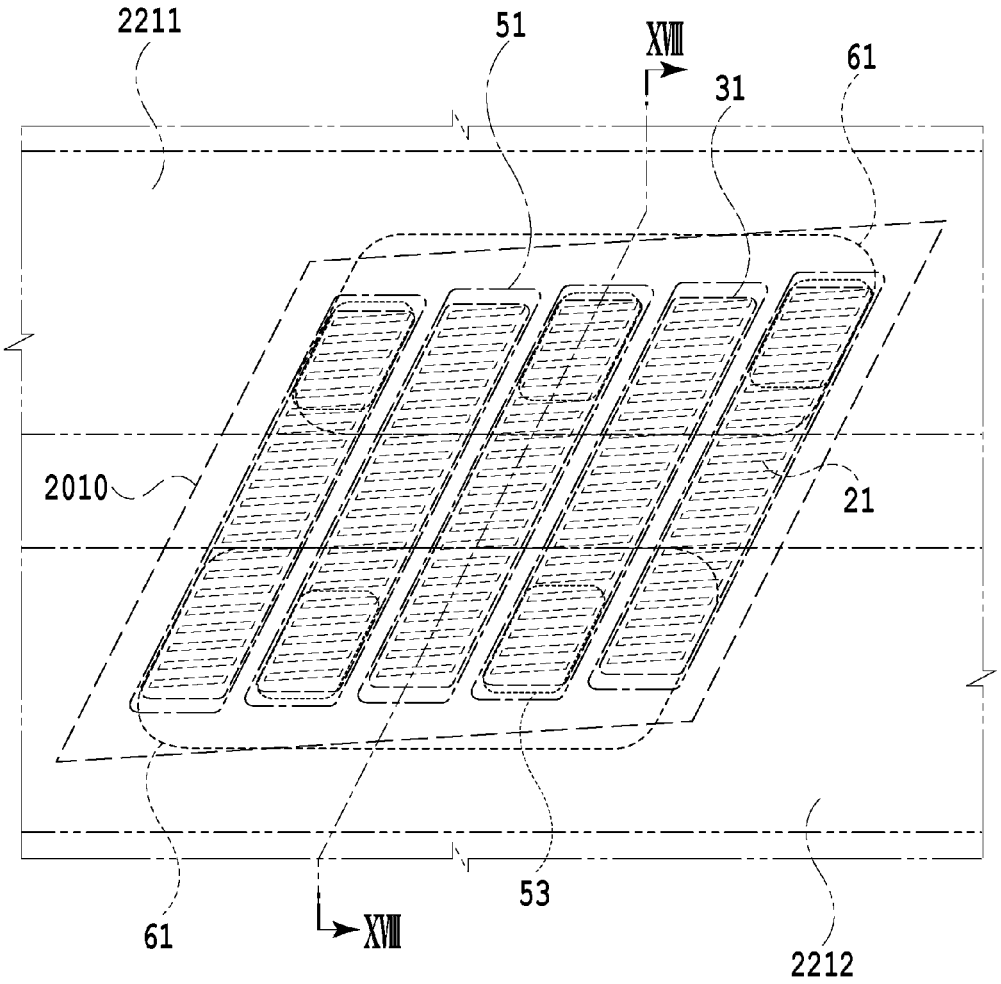
FIG. 17 is a perspective view illustrating a liquid connection relation between the print element board and the passage member.

FIG. 17 is a perspective view illustrating a liquid connection relation between the print element board 2010 and the passage member 2210. A pair of the common supply passage 2211 and the common collection passage 2212 extending in the longitudinal direction of the liquid ejection head 2003 is provided inside the passage member 2210. The communication opening 61 of the second passage member 2060 is connected to the individual communication opening 53 of the first passage member 2050 so that both positions match each other and the liquid supply passage communicating with the communication opening 51 of the first passage member 2050 through the communication opening from the common supply passage 2211 of the second passage member 2060 is formed. Similarly, the liquid the supply path communicating with the communication opening 51 of the first passage member 2050 through the common collection passage 2212 from the communication opening 72 of the second passage member 2060 is also formed.

Figure 18:
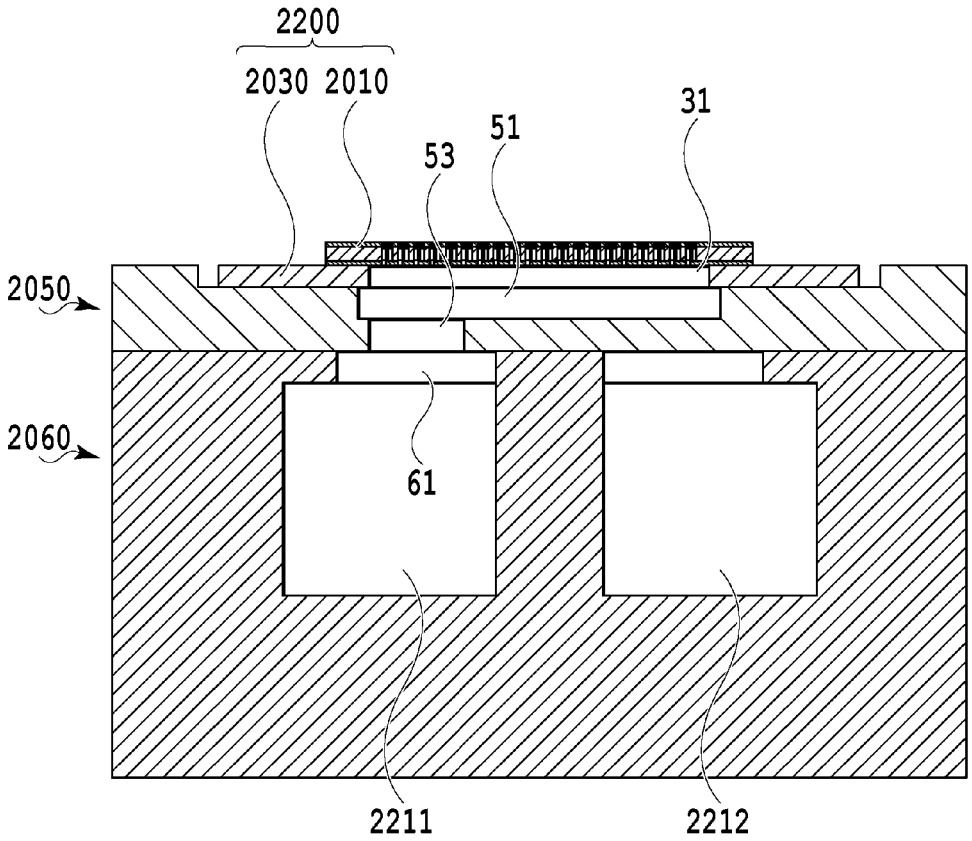
FIG. 18 is a cross-sectional view taken along a line XVIII-XVIII of FIG. 17.

FIG. 18 is a cross-sectional view taken along a line XVIII-XVIII of FIG. 17. The common supply passage 2211 is connected to the ejection module 2200 through the communication opening 61, the individual communication opening 53, and the communication opening 51. Although not illustrated in FIG. 18, it is obvious that the common collection passage 2212 is connected to the ejection module 2200 by the same path in a different cross-section in FIG. 17. Similarly to the first application example, each of the ejection module 2200 and the print element board 2010 is provided with a passage communicating with each ejection opening and thus a part or the entirety of the supplied liquid can be re-circulated while passing through the ejection opening that does not perform the ejection operation. Further, similarly to the first application example, the common supply passage 2211 is connected to the negative pressure control unit 2230 (the high pressure side) and the common collection passage 2212 is connected to the negative pressure control unit 2230 (the low pressure side) through the liquid supply unit 2220. Thus, a flow is generated so that the liquid flows from the common supply passage 2211 to the common collection passage 2212 through the pressure chamber of the print element board 2010 by the differential pressure.

(Description of Ejection Module)

Figure 19A:
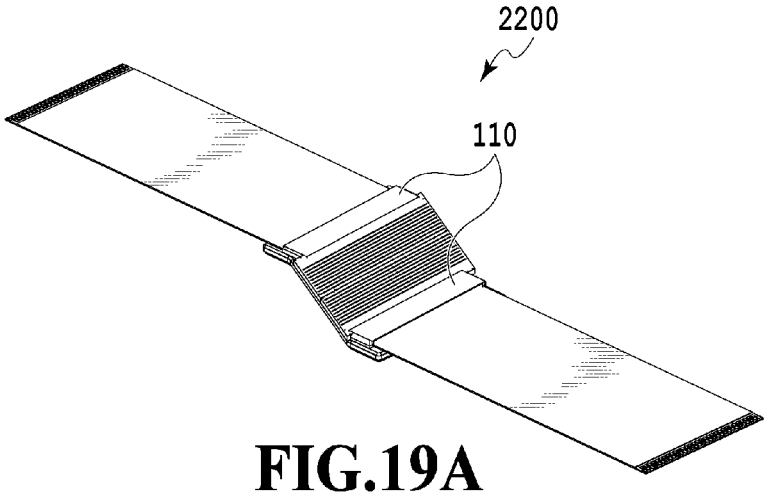
FIG. 19A is a perspective view illustrating one ejection module.
Figure 19B:
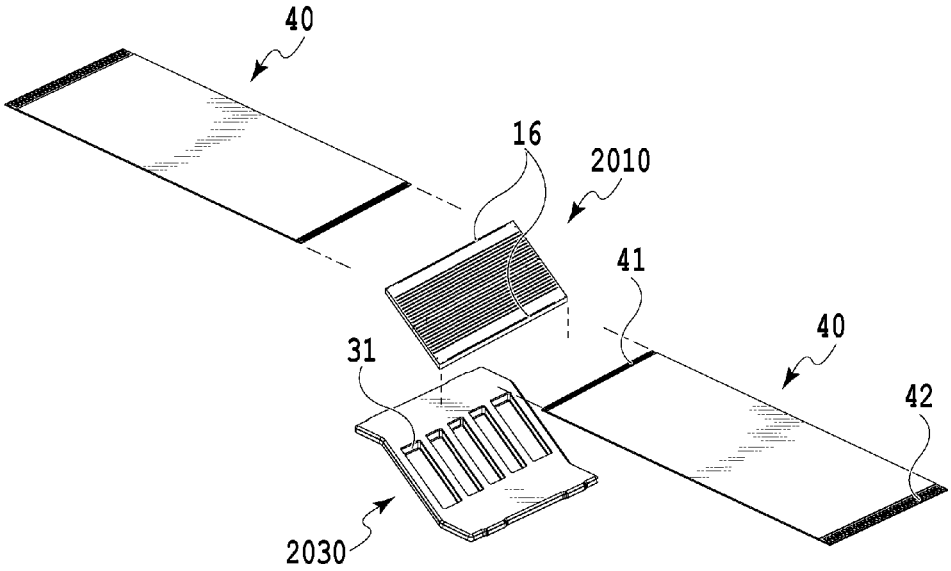
FIG. 19B is an exploded perspective view illustrating one ejection module.

FIG. 19A is a perspective view illustrating one ejection module 2200 and FIG. 19B is an exploded view thereof. A difference from the first application example is that the terminals 16 are respectively disposed at both sides (the long side portions of the print element board 2010) in the ejection opening row directions of the print element board 2010. Accordingly, two flexible circuit boards 40 electrically connected to the print element board 2010 are disposed for each print element board 2010. Since the number of the ejection opening rows provided in the print element board 2010 is twenty, the ejection opening rows are more than eight ejection opening rows of the first application example. Here, since a maximal distance from the terminal 16 to the print element is shortened, a decrease in voltage or a delay of a signal generated in the wiring portion inside the print element board 2010 is reduced. Further, the liquid communication opening 31 of the support member 2030 is opened along the entire ejection opening row provided in the print element board 2010. The other configurations are similar to those of the first application example.

(Description of Structure of Print Element Board)

Figure 20:
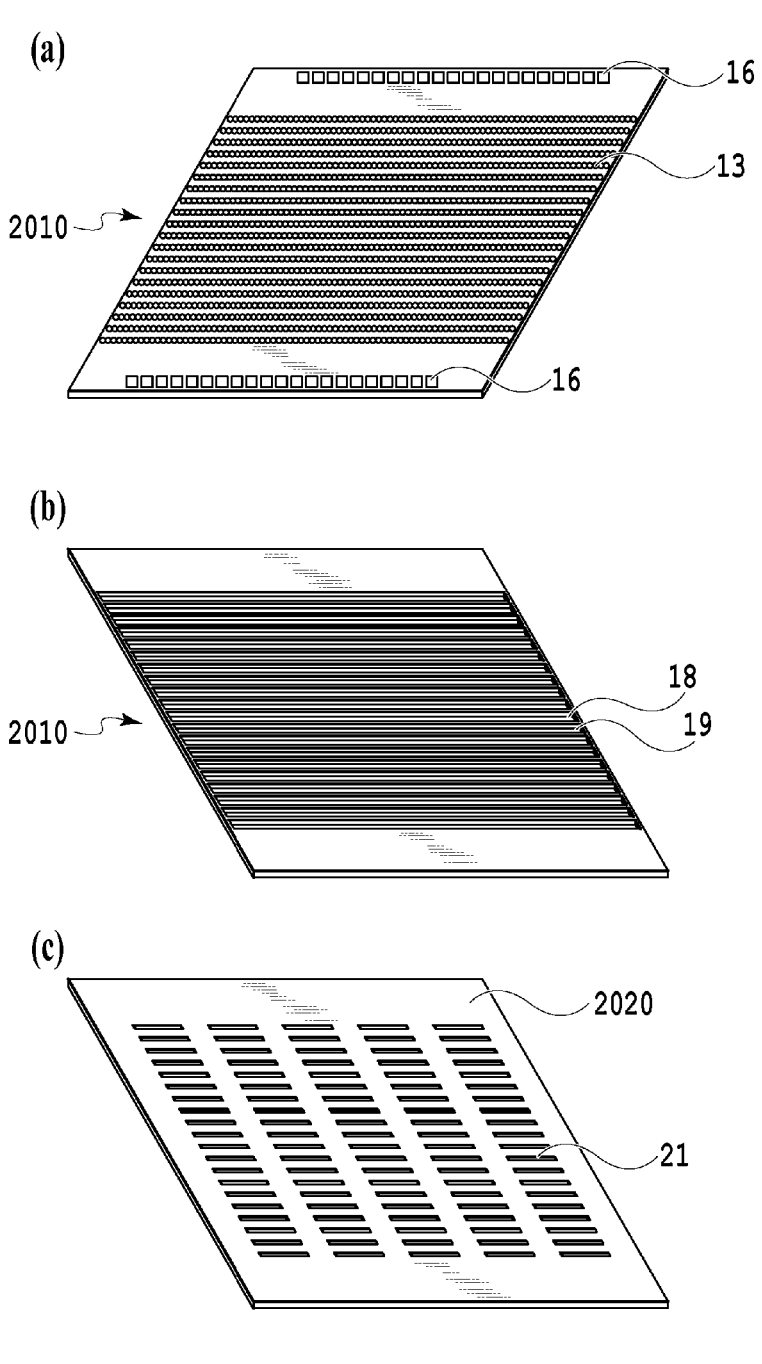
FIG. 20 is a schematic diagram illustrating the print element board.

Reference character (a) of FIG. 20 is a schematic diagram illustrating a face on which the ejection opening is disposed in the print element board 2010 and reference character (c) of FIG. 20 is a schematic diagram illustrating a rear face of the face of reference character (a) of FIG. 20. Reference character (b) of FIG. 20 is a schematic diagram illustrating a face of the print element board 2010 in a case where a lid member 2020 provided in the rear face of the print element board 2010 in reference character (c) of FIG. 20 is removed. As illustrated in reference character (b) of FIG. 20, the liquid supply path and the liquid collection path 19 are alternately provided along the ejection opening row direction at the rear face of the print element board 2010. The number of the ejection opening rows is larger than that of the first application example. However, a basic difference from the first application example is that the terminal 16 is disposed at both sides of the print element board in the ejection opening row direction as described above. A basic configuration is similar to the first application example in that a pair of the liquid supply path 18 and the liquid collection path 19 is provided in each ejection opening row and the lid member 2020 is provided with the opening 21 communicating with the liquid communication opening 31 of the support member 2030.

In addition, the description of the above-described application example does not limit the scope of the invention. As an example, in the application example, a thermal type has been described in which bubbles are generated by a heating element to eject the liquid. However, the invention can be also applied to the liquid ejection head which employs a piezo type and the other various liquid ejection types.

In the application example, the inkjet printing apparatus (the printing apparatus) has been described in which the liquid such as ink is circulated between the tank and the liquid ejection head, but the other application examples may be also used. In the other application examples, for example, a configuration may be employed in which the ink is not circulated and two tanks are provided at the upstream side and the downstream side of the liquid ejection head so that the ink flows from one tank to the other tank. In this way, the ink inside the pressure chamber may flow.

In the application example, an example of using a so-called line type head having a length corresponding to the width of the print medium has been described, but the invention can be also applied to a so-called serial type liquid ejection head which prints an image on the print medium while scanning the print medium. As the serial type liquid ejection head, for example, the liquid ejection head may be equipped with a print element board ejecting black ink and a print element board ejecting color ink, but the invention is not limited thereto. That is, a liquid ejection head which is shorter than the width of the print medium and includes a plurality of print element boards disposed so that the ejection openings overlap each other in the ejection opening row direction may be provided and the print medium may be scanned by the liquid ejection head.

Third Application Example (Embodiment)

(Description of Configuration of Liquid Ejection Head)

Figure 22:
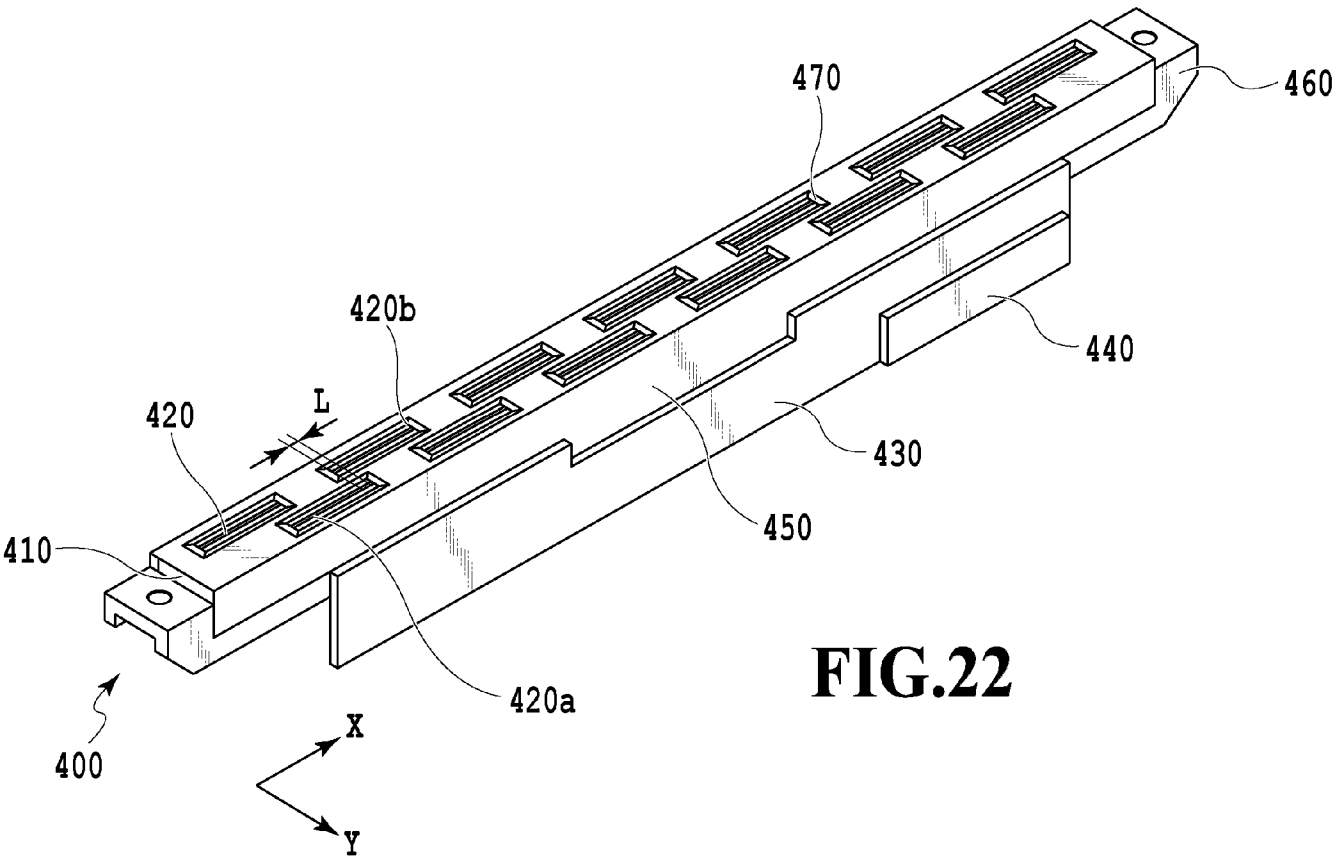
FIG. 22 is a perspective view illustrating a liquid ejection head according to the embodiment.

Hereinafter, a configuration of a liquid ejection head 400 according to the embodiment will be described. Further, in the description below, only a difference from the above-described embodiments will be mainly described and a description of the same components as those of the above-described embodiments will be omitted. FIG. 22 is a perspective view illustrating the liquid ejection head 400 according to the embodiment. Here, a coordinate axis is set as illustrated in the drawings for the description of the embodiment.

Referring to FIG. 22, one elongated liquid ejection head 400 has a configuration in which a plurality of print element boards 420 having a plurality of print elements ejecting a liquid such as ink and densely arranged are arranged on a passage member 410 in the X direction while being alternately deviated from each other in the Y direction. An overlapping area (indicated by "L" in FIG. 22) is provided between two adjacent print element boards (for example, 420*a* and 420*b*). Accordingly, even in a case where the print element boards are arranged with a slight error, a gap caused by the error is not formed on a printing medium which is conveyed in the Y direction so that an image is printed thereon. An electric wiring board 430 is an electronic circuit substrate which is formed of a composite material such as glass epoxy and supplies power necessary for an ejection operation and an ejection drive signal to each print element board 420 and includes a connector 440 which receives a signal or power from the outside. A flexible circuit board 450 electrically connects the passage member 410 to the electric wiring board 430 and connects each print element board 420 to the electric wiring board 430. The passage member 410, the print element board 420, and the electric wiring board 430 which are electrically connected to one another are integrally supported by a support portion 460. An electrical connection portion between the print element board 420 and the flexible circuit board 450 is coated by a sealing member 470 (epoxy resin or the like) having an excellent sealing property and an excellent ion interception property to be protected.

Further, the liquid ejection head 400 includes a heating heater (not illustrated) which increases a temperature of the liquid ejection head 400. The liquid ejection head 400 is provided to solve concern of deterioration in image quality caused by an increase in temperature of the liquid ejection head 400 in the middle of forming a high-duty image by ejecting the ink. In the embodiment, the temperature of the liquid ejection head 400 is increased by a heating heater, and then the temperature of the liquid ejection head 400 remain high in a previous step of forming an image by ejecting the ink. Accordingly, an increase in temperature of the liquid ejection head 400 during an operation of forming an image by ejecting the ink is suppressed to prevent deterioration in image quality (which will be described later in detail).

(Description of Configuration of Passage)

Hereinafter, a configuration of a passage of a liquid flowing through the liquid ejection head 400 according to the embodiment will be described. Similarly to the above-described embodiments, the liquid ejection head 400 includes a liquid ejection unit which ejects a liquid and a liquid supply unit which supplies a liquid to the liquid ejection unit. Then, the liquid ejection unit includes the print element boards 420.

Figures 23A, 23B, 23C, 23D:
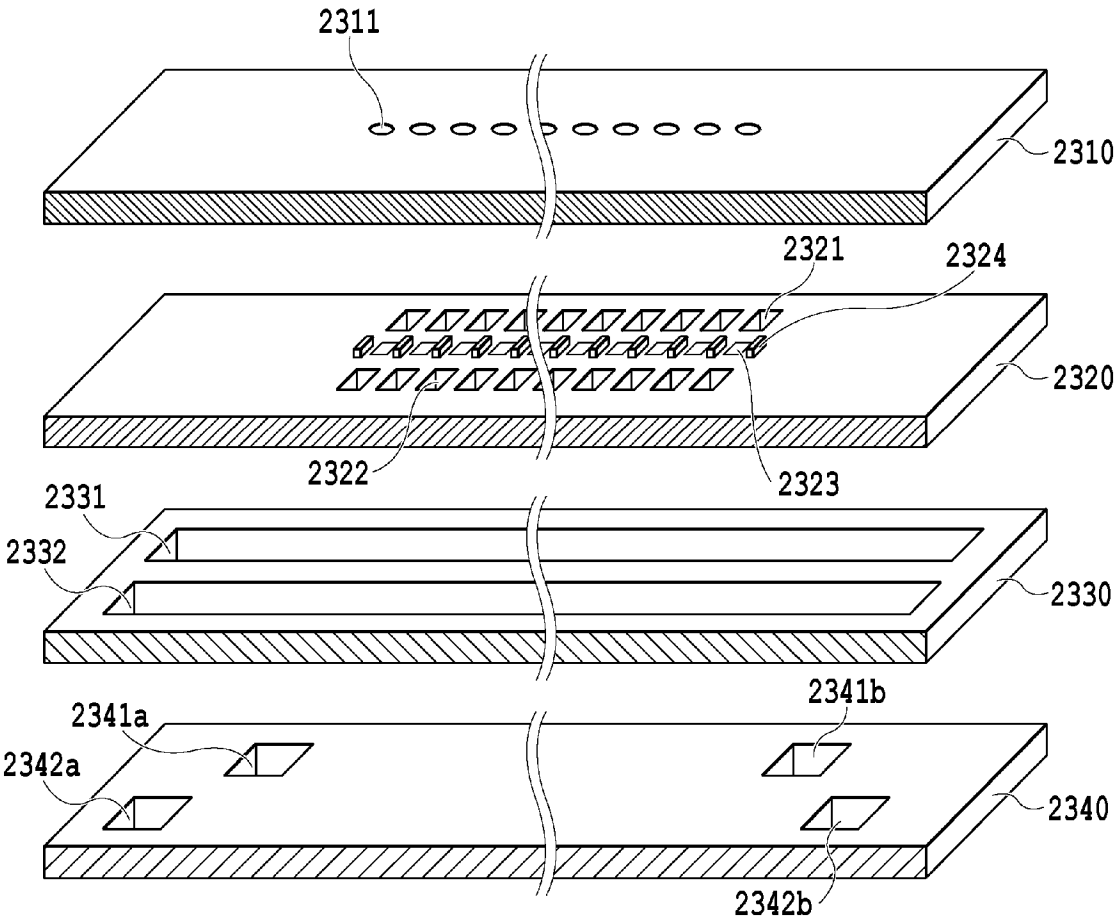
FIGS. 23A to 23D are diagrams illustrating a lamination structure of a print element board according to the embodiment.

FIGS. 23A to 23D are perspective views illustrating members constituting the print element board 420 according to the embodiment and illustrate a lamination structure of the print element board 420. A configuration of the passage inside the print element board will be described with reference to FIGS. 23A to 23D. FIG. 23A illustrates an ejection opening forming member 2310 provided with a plurality of ejection openings 2311. FIG. 23B illustrates an individual supply passage 2321, an individual collection passage 2322, and a first passage member 2320 provided with a driving circuit and the like. FIG. 23C illustrates a second passage member 2330 provided with a common supply passage 2331 and a common collection passage 2332. FIG. 23D illustrates a third passage member 2340 provided with a plurality of communication openings 2341*a*, 2341*b*, 2342*a*, and 2342*b*. In a case where a position provided with the communication opening is adjusted (a distance between the communication opening 2341*a* and the communication opening 2341*b* (or a distance between the communication opening 2342*a* and the communication opening 2342*b*) is adjusted), a length (a pitch) of the passage through which the liquid flows in the common supply passage and the common collection passage can be adjusted. In a case where the structures illustrated in FIGS. 23A to 23D are combined with one another, one chip of the print element board 420 is obtained.

The liquid which is supplied from the liquid connection portion of the support portion 460 to each print element board reaches a pressure chamber through the communication openings 2341*a* and 2341*b*, the common supply passage 2331, and the individual supply passage 2321. Subsequently, the liquid is discharged from the communication openings 2342*a* and 2342*b* through the individual collection passage 2322 and the common collection passage 2332. Further, in FIG. 23D, the communication openings 2341*a* and 2341*b* (and the communication openings 2342*a* and 2342*b*) are located at both ends in the ejection opening row, but a plurality of communication openings may be disposed inside the ejection opening row. That is, a pitch between the communication openings may be a pitch in which the passage members supplying and collecting the liquid can be bonded to each other.

Figure 24A:
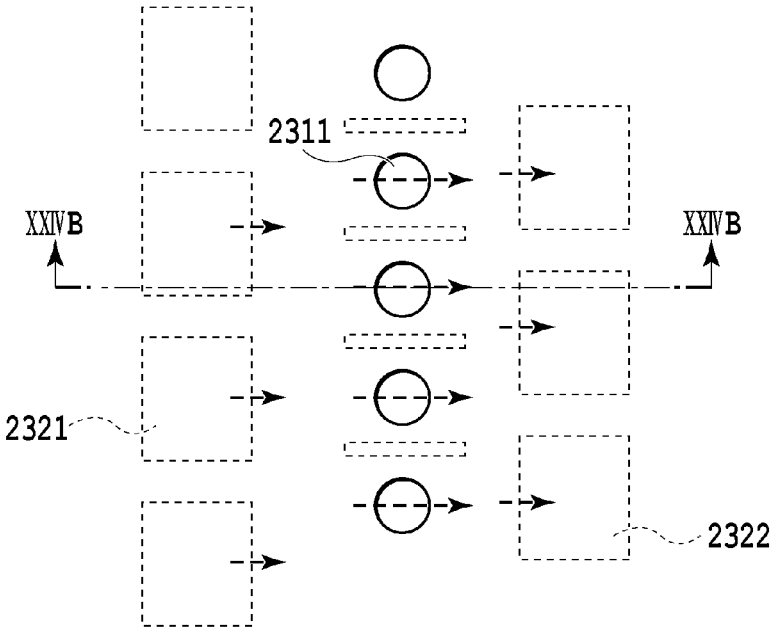
FIGS. 24A and 24B are diagrams illustrating a nozzle portion of the liquid ejection head according to the embodiment.
Figure 24B:
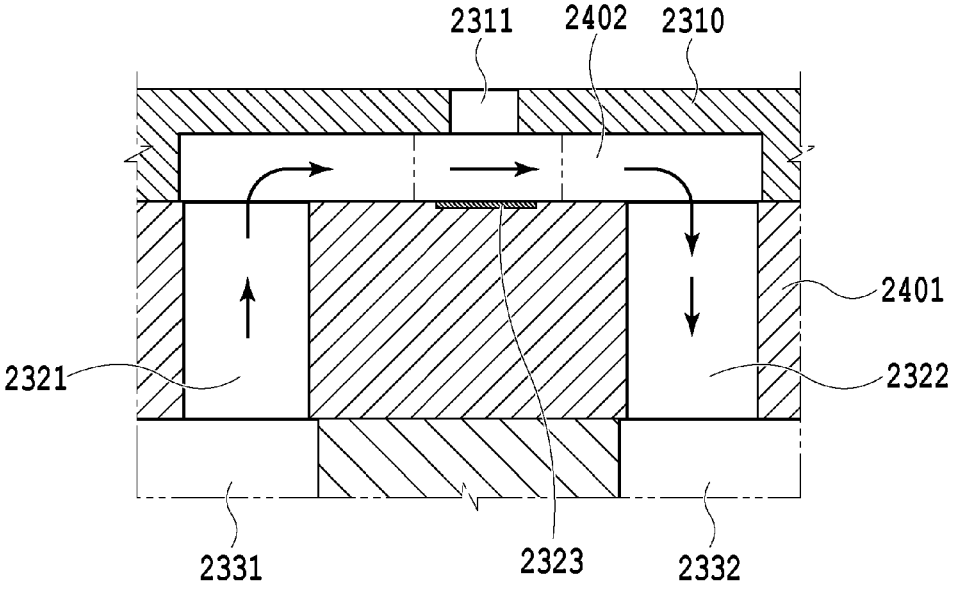

FIG. 24A is a top view illustrating a nozzle portion of the liquid ejection head 400 according to the embodiment and FIG. 24B is a cross-sectional view taken along a line XXIVB-XXIVB of FIG. 24A. The nozzle portion of the liquid ejection head 400 has a configuration in which an ejection opening 2311 and a pressure chamber 2402 filled with a liquid are provided in the ejection opening forming member 2310 on a substrate 2401 provided with a print element 2323 serving as a heating element forming a liquid into bubbles by heat energy. As illustrated in FIG. 23B, the first passage member 2320 is provided with the individual supply passages 2321 and the individual collection passages 2322 in the longitudinal direction. Further, a plurality of partition walls 2324 are provided in the longitudinal direction between the individual supply passages 2321 and the individual collection passages 2322 on the first passage member 2320. The partition wall 2324 serves as a part of a wall of the pressure chamber 2402. In each pressure chamber, the ejection opening 2311 is formed at a position facing the print element 2323. In order to form an image on the printing medium on the basis of image data included in a printing job corresponding to a printing target acquired by the printing apparatus, one or a plurality of the print elements 2323 are selectively driven and the ink is ejected from the ejection opening corresponding to the driven print element 2323. Further, as described above, the liquid ejection head 400 includes a heating heater which increases the temperature of the liquid ejection head 400, but the print element 2323 may be used as the heating heater.

Figure 25:
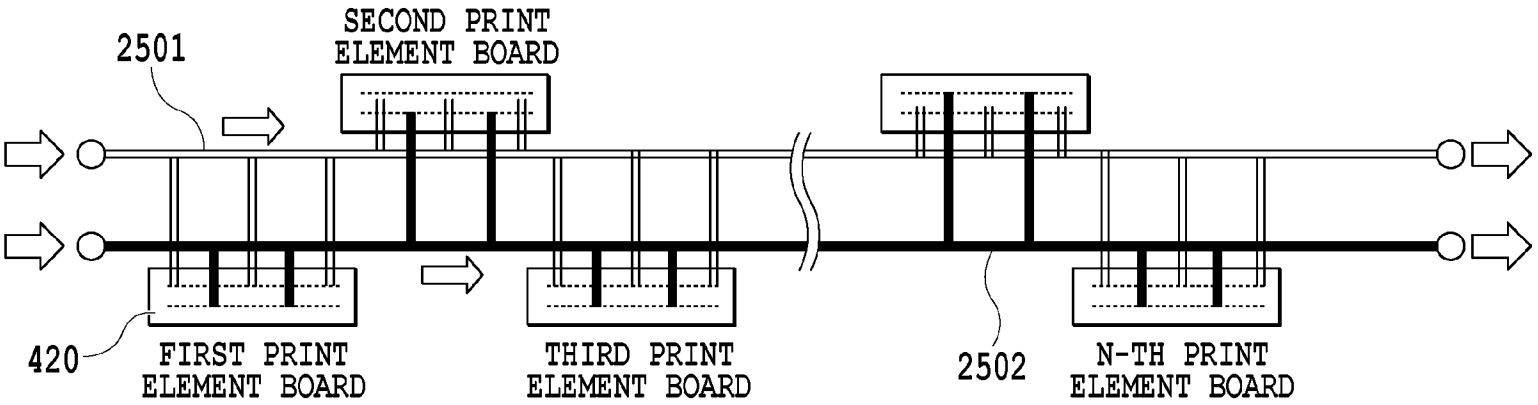
FIG. 25 is a schematic diagram illustrating a passage inside a liquid ejection unit according to the embodiment.

FIG. 25 is a schematic diagram illustrating a passage inside the liquid ejection unit by focusing on a common passage which supplies a liquid to each print element board inside the liquid ejection unit, a common passage which collects a liquid from each print element board, and the print element boards. As illustrated in FIG. 25, in the embodiment, a common supply passage 2501 which supplies a liquid to each print element board and a common collection passage 2502 which collects a liquid from each print element board are provided inside the liquid ejection unit similarly to the first embodiment. In each print element board 420, the liquid flowing through the common supply passage 2501 is drawn through the communication openings 2341*a* and 2341*b* to be circulated inside the print element board and is discharged through the communication openings 2342*a* and 2342*b* (see FIGS. 23A to 23D). Hereinafter, this configuration will be described in detail.

The liquid flows in one direction at all times in the common supply passage 2501 and the common collection passage 2502, but a differential pressure (a difference in pressure) is generated between the common supply passage 2501 and the common collection passage 2502 by a negative pressure control unit to be described later. By the differential pressure, a flow from the common supply passage 2501 to the common collection passage 2502 is generated. That is, the liquid flows in order of the common supply passage 2501, the communication openings 2341*a* and 2341*b*, the common supply passage 2331, the individual supply passage 2321, the pressure chamber 2402, the individual collection passage 2322, the common collection passage 2332, the communication openings 2342*a* and 2342*b*, and the common collection passage 2502. A difference in pressure between the common supply passage 2501 and the common collection passage 2502 is set so that a flow rate inside the pressure chamber 2402 becomes about several millimeters per second to several tens of millimeters per second.

(Description of Circulation Configuration)

Figure 26:
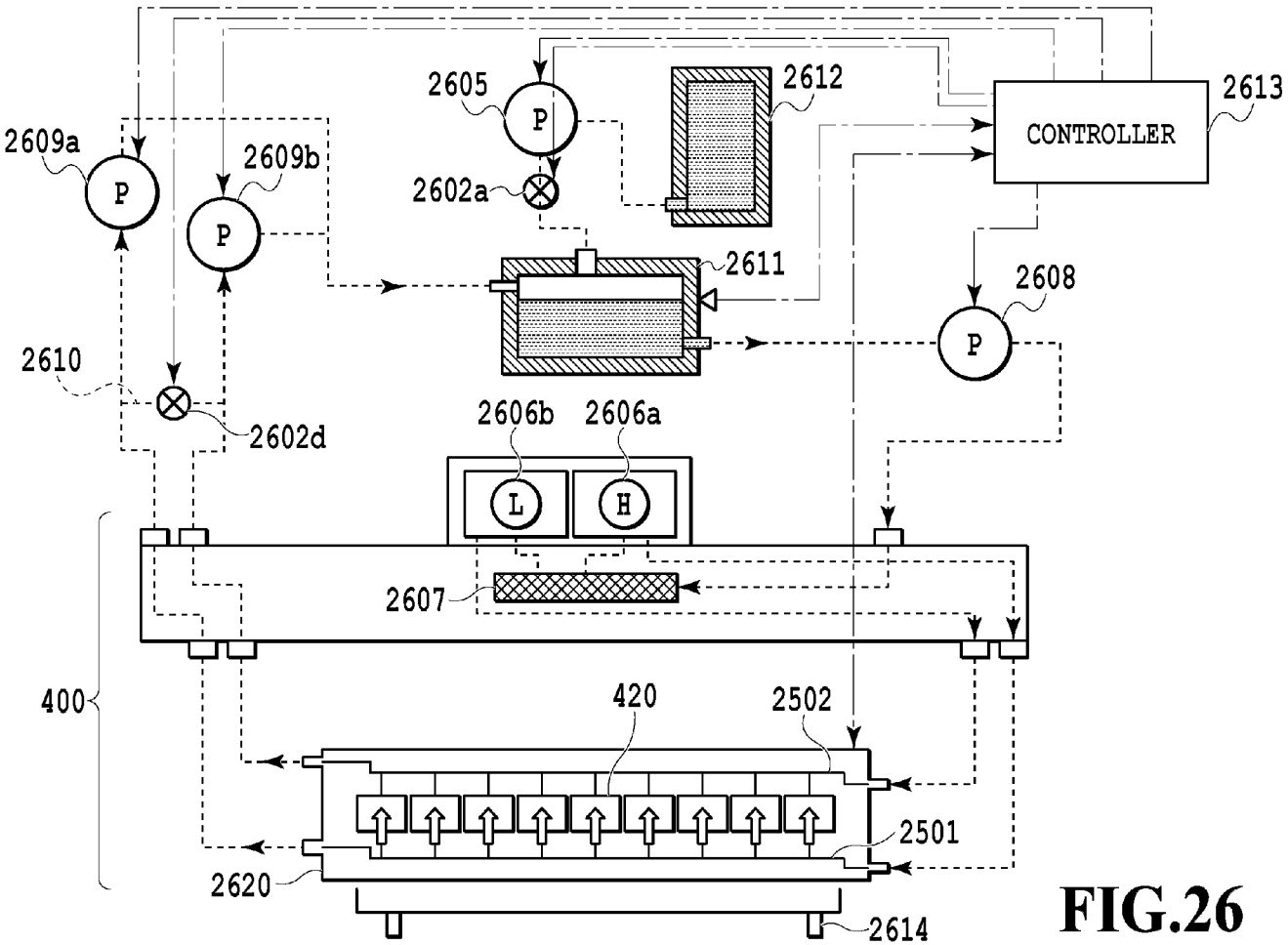
FIG. 26 is a schematic diagram illustrating a circulation configuration according to the embodiment.

FIG. 26 is a schematic diagram illustrating an example of a circulation system applied to the printing apparatus according to the embodiment. As illustrated in FIG. 26, the liquid ejection head 400 is fluid-connected to a first circulation pump (at the high pressure side) 2609*a*, a first circulation pump (at the low pressure side) 2609*b*, a buffer tank 2611, and a second circulation pump 2608. Further, an openable cap 2614 is attached to the liquid ejection head 400 in order to suppress an evaporation of the liquid from the nozzle. In order to wet a space inside the cap while closing the cap 2614, an absorbing member that absorbs the liquid is disposed inside the cap 2614 or humid air is supplied thereto to suppress the evaporation of the liquid of the nozzle. Further, the printing apparatus of the embodiment includes a controller 2613 which generally controls components constituting the circulation system. The controller 2613 includes a CPU, a ROM, and a RAM (not illustrated) and generally controls the printing apparatus by loading a program stored in the ROM into the RAM to execute the program.

The liquid which is pressurized by the second circulation pump 2608 serving as a constant pressure pump is supplied to the liquid ejection head 400, passes through a filter 2607, and is supplied to a negative pressure control unit 2606*a* or a negative pressure control unit 2606*b*. In each of the negative pressure control unit 2606*a* and the negative pressure control unit 2606*b*, a negative pressure at the downstream side of the negative pressure control unit is set to a predetermined negative pressure. Here, the negative pressure control unit 2606*a* at the high pressure side among two negative pressure control units is connected to the upstream side of the common supply passage 2501 inside the liquid ejection unit 2620 and the negative pressure control unit 2606*b* at the low pressure side is connected to the upstream side of the common collection passage 2502. Accordingly, a differential pressure is generated between the common supply passage 2501 and the common collection passage 2502 and a flow is generated in order of the common supply passage 2501, the print element board 420, and the common collection passage 2502. In a case where the differential pressure between the common supply passage 2501 and the common collection passage 2502 is adjusted by the control of the negative pressure control units 2606*a* and 2606*b*, a circulation flow rate of the nozzle portion can be set to a desired flow rate.

The first circulation pumps 2609*a* and 2609*b* are provided at the downstream side of the liquid ejection head 400. Two first circulation pumps are constant rate pumps and draw the liquid from the common passage inside the liquid ejection head 400 at a constant flow rate so that the liquid is collected to the buffer tank 2611. The liquid which is collected to the buffer tank 2611 is pressurized again by the second circulation pump 2608 and is supplied to the liquid ejection head 400. In this way, in the circulation system according to the embodiment, the liquid flows in order of the buffer tank 2611, the second circulation pump 2608, the liquid ejection head 400, the first circulation pumps 2609*a* and 2609*b*, and the buffer tank 2611.

In the embodiment, the amount of the ink inside the circulation system decreases in accordance with a printing operation using ejected ink, an evaporation, and a suction recovery operation. However, when the amount of the ink decreases by a predetermined amount or more, this state is detected by a sensor attached to the buffer tank 2611 and the insufficient ink is replenished from the main tank 2612. A change in color concentration of the ink in such a circulation system is expressed by Equation (1) below.

$$w_{pig}(t) = \left(w_{pig}0 - \frac{Q}{Q1}\cdot w_{pig}0\right)\cdot \exp\left(\frac{-Q1}{w_{sub}}\cdot t\right) + \frac{Q}{Q1}\cdot w_{pig}0 \qquad \text{[Equation 1]}$$

Here, $W_{pig}(t)$ [wt %] indicates the color concentration of the ink inside the buffer tank 2611. $W_{pig}0$ [wt %] indicates the color concentration of the ink inside the main tank 2612. $W_{sub}$ [g] indicates the capacity of the buffer tank 2611. Q1 [g/sec] indicates the sum of the amount of the ink ejected per second and the amount (the recovery use amount) used for the recovery. Q2 [g/sec] indicates the evaporation amount per second (hereinafter, referred to as an "evaporation speed"). Q (=Q1+Q2) [g/sec] indicates the amount of the ink replenished from the main tank 2612 per second. t [sec] indicates the elapse time.

Figure 30:
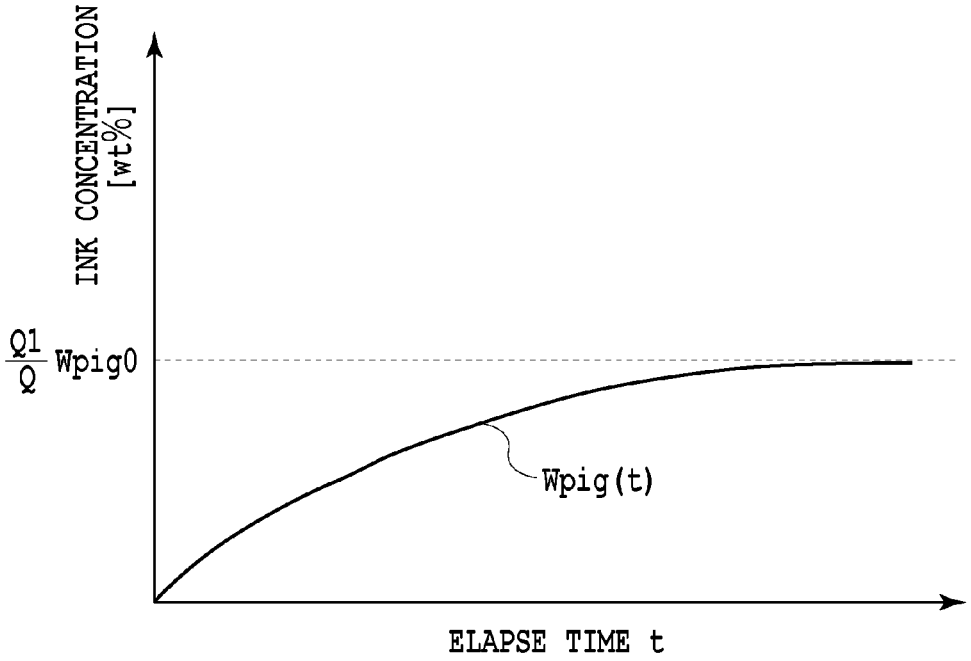
FIG. 30 is a graph illustrating a change in time of concentration of ink inside a circulation system according to the embodiment.

The right side of Equation (1) converges on $Q/Q1\cdot W_{pig}0$ when the value of t increases (see FIG. 30). From Equation (1), when the evaporation is suppressed, the arrival concentration of $W_{pig}(t)$ is suppressed (when the evaporation is suppressed, Q2 approaches 0, the first part of the right side of Equation (1) approaches zero, and the value of the right side of Equation (1) approaches $Q/Q1\cdot W_{pig}0$).

Figure 27:
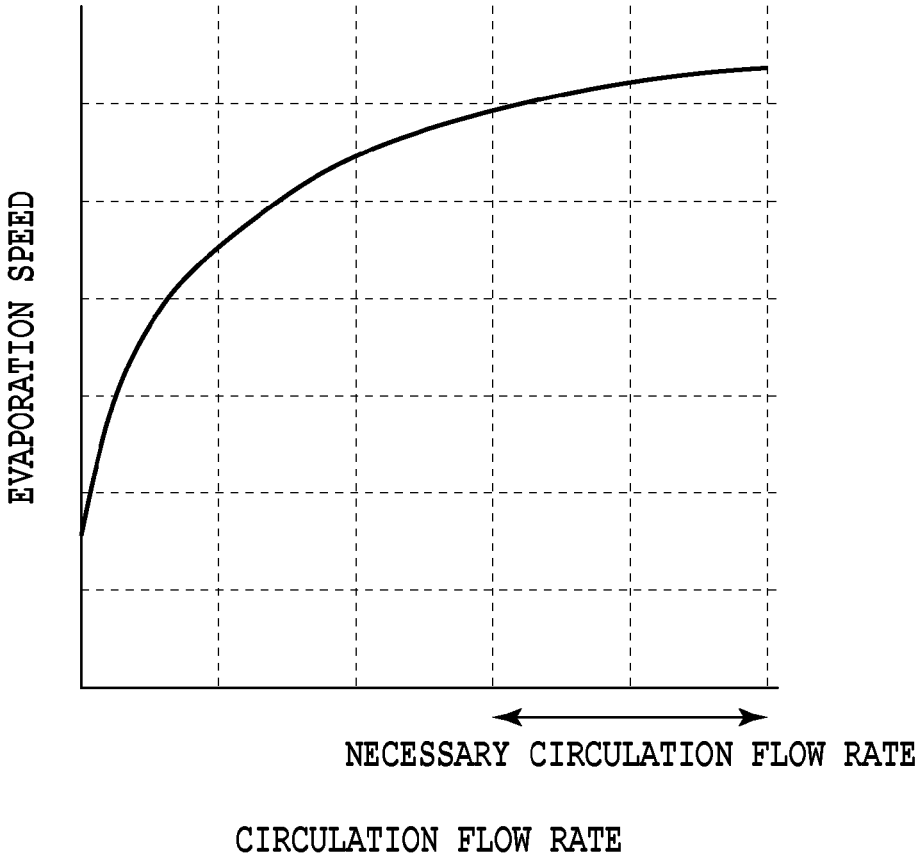
FIG. 27 is a graph illustrating a relation between a circulation flow rate and an evaporation speed according to the embodiment.

FIG. 27 is a graph illustrating a relation between the ink evaporation amount per second (that is, the evaporation speed) of one nozzle not ejecting the ink and the circulation flow rate of the circulation system according to the embodiment. As illustrated in FIG. 27, when the circulation flow is generated, the evaporation speed steeply increases. As the circulation flow rate becomes fast, fresh ink is supplied to the front end of the nozzle and thus a higher circulation effect can be obtained. Meanwhile, the evaporation of the liquid from the nozzle is promoted as the circulation flow rate becomes faster. When the circulation flow rate becomes a predetermined value or more, the circulation flow is always supplied to the front end of the nozzle. For this reason, a circulation effect cannot be easily improved and a change in evaporation speed in accordance with a change in circulation flow rate decreases. In consideration of this state, it is desirable that the circulation flow rate fall within a range indicated by a "necessary circulation flow rate" in the drawing. Further, since the liquid evaporates from the nozzle by the generation of the circulation flow and the evaporation is promoted in accordance with an increase in circulation flow rate, it is desirable to stop the circulation in a state where a printing process based on a printing job is not performed. It is desirable to minimize the circulation even in a case where the printing process is performed on the basis of the printing job.

(Description of Flow of Process)

Hereinafter, a flow of a process according to the embodiment will be described. Steps in the process to be described below are performed by the controller 2613.

Figure 28C:
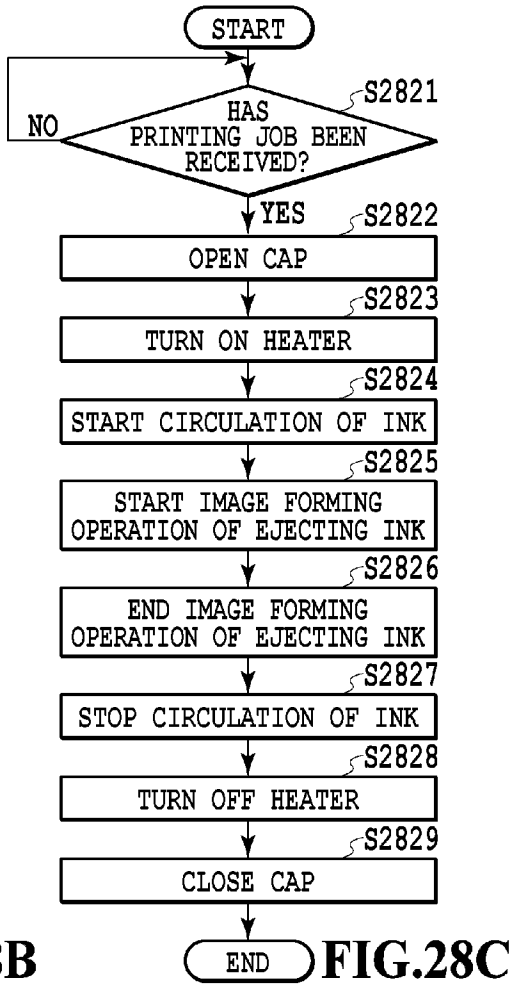
FIGS. 28A to 28C are flowcharts illustrating a process according to the embodiment.
Figure 28B:
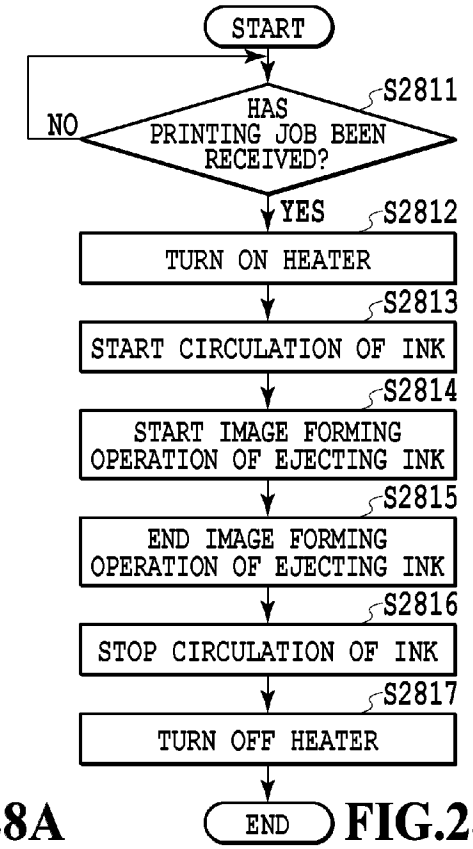
Figure 28A:
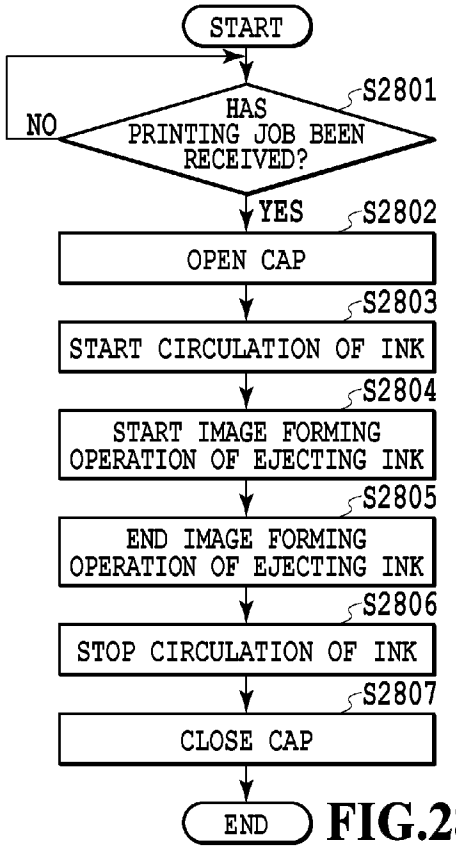

FIG. 28A is a flowchart illustrating a sequence of a printing process accompanied with a cap opening/closing process. When the process starts, the cap 2614 is in a closed state. In step S2801, it is determined whether a printing job is received. In a case where the printing job is received as a result of the determination, a routine proceeds to step S2802. Meanwhile, in a case where the printing job is not received, a process of step S2801 is performed again. In step S2802, the cap 2614 is opened. In step S2803, the first circulation pump 2609*a* and the first circulation pump 2609*b* are operated to generate the circulation flow of the ink (a start of an ink circulation). In step S2804, an image forming operation of ejecting the ink from the nozzle onto a printing medium is started on the basis of image data included in the received printing job. In step S2805, the image forming operation of ejecting the ink is ended. In step S2806, the operations of the first circulation pump 2609*a* and the first circulation pump 2609*b* are stopped to stop the circulation flow of the ink (a stop of an ink circulation). In step S2807, the cap 2614 is closed and a series of processes are ended.

The above-described process is a printing process accompanied with the cap opening/closing operation according to the embodiment.

FIG. 28B is an example different from that of FIG. 28A and is a flowchart illustrating a printing process accompanied with the liquid ejection head temperature adjusting operation. When the process starts, the temperature of the liquid ejection head 400 is in a low state. In step S2811, it is determined whether a printing job is received. In a case where the printing job is received as a result of the determination, a routine proceeds to step S2812. Meanwhile, in a case where the printing job is not received, a process of step S2811 is performed again. In step S2812, a heating heater is turned on so that the temperature of the liquid ejection head 400 increases. In step S2813, the first circulation pump 2609*a* and the first circulation pump 2609*b* are operated to generate the circulation flow of the ink (the start of the ink circulation). In step S2814, an image forming operation of ejecting the ink from the nozzle onto a printing medium is started on the basis of image data included in the received printing job. In step S2815, the image forming operation of ejecting the ink is ended. In step S2816, the operations of the first circulation pump 2609*a* and the first circulation pump 2609*b* are stopped to stop the circulation flow of the ink (the stop of the ink circulation). In step S2817, the heating heater is turned off so that a series of processes end.

The above-described process is a printing process accompanied with the liquid ejection head temperature adjusting operation according to the embodiment.

FIG. 28C is an example different from those of FIGS. 28A and 28B and is a flowchart illustrating a sequence of the printing process accompanied with the cap opening/closing operation and the liquid ejection head temperature adjusting operation. When the process starts, the cap 2614 is in a closed state. Meanwhile, the temperature of the liquid ejection head 400 is in a low state. In step S2821, it is determined whether a printing job is received. In a case where the printing job is received as a result of the determination, a routine proceeds to step S2822. Meanwhile, in a case where the printing job is not received, a process of step S2821 is performed again. In step S2822, the cap 2614 is opened. In step S2823, the heating heater is turned on so that the temperature of the liquid ejection head 400 increases. In step S2824, the first circulation pump 2609*a* and the first circulation pump 2609*b* are operated to generate the circulation flow of the ink (the start of the ink circulation). In step S2825, an image forming operation of ejecting the ink from the nozzle onto a printing medium is started on the basis of image data included in the received printing job. In step S2826, the image forming operation of ejecting the ink is ended. In step S2827, the operations of the first circulation pump 2609*a* and the first circulation pump 2609*b* are stopped to stop the circulation flow of the ink (the stop of the ink circulation). In step S2828, the heating heater is turned off. In step S2829, the cap 2614 is closed and a series of processes end.

The above-described process is a printing process accompanied with the cap opening/closing operation and the liquid ejection head temperature adjusting operation according to the embodiment.

Figure 29:
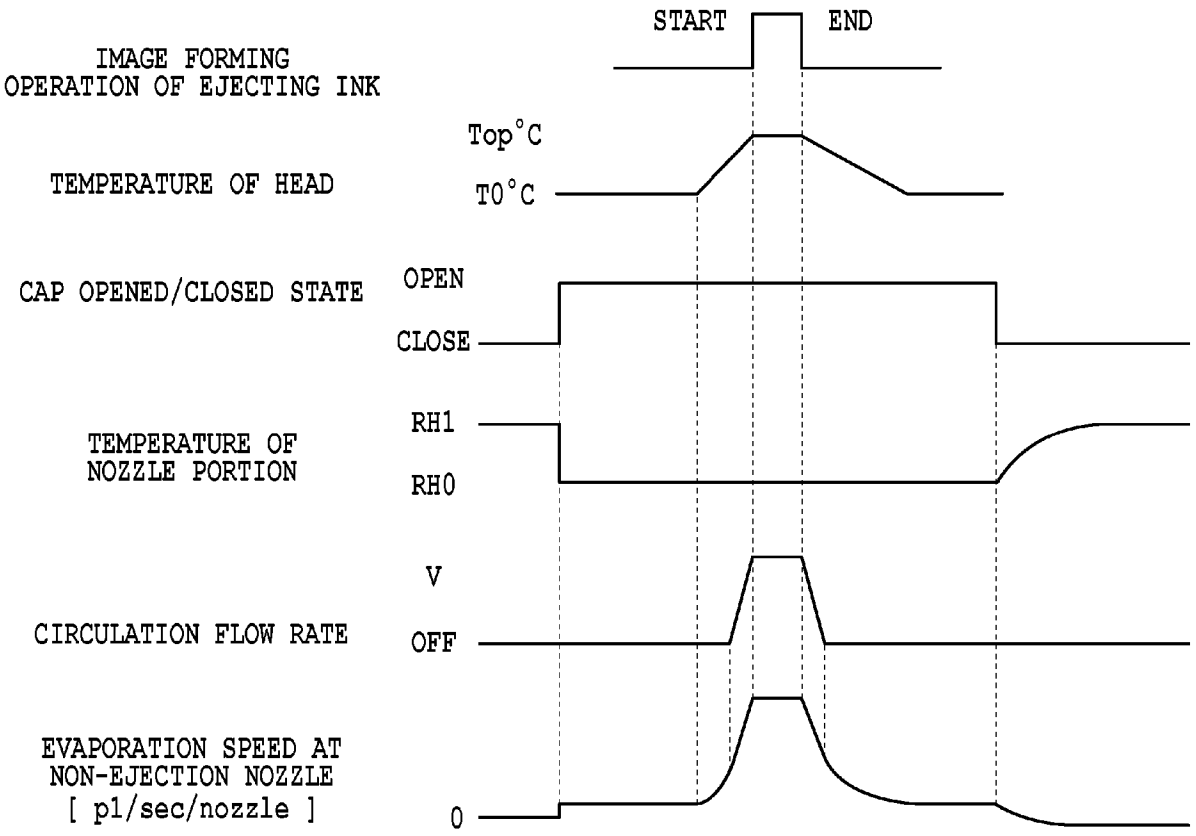
FIG. 29 is a timing chart illustrating a process according to the embodiment.

FIG. 29 is a timing chart of the process illustrated in FIG. 28C.

In the embodiment, a state of the printing apparatus before the printing apparatus receives the printing job will be referred to as a "standby state". Further, when the printing apparatus is in the standby state, the operations of the first circulation pump 2609*a* and the first circulation pump 2609*b* are stopped to stop the circulation flow of the ink. At this time, the temperature of the liquid ejection head 400 in the standby state is set to T0 and the humidity of the nozzle portion in the standby state is set to RH1. When the printing apparatus receives the printing job, the cap 2614 is opened. When the cap 2614 is opened, the humidity of the nozzle portion is equal to the humidity (RH0) of the environment provided with the printing apparatus and thus a volatile component of the ink evaporates from the nozzle.

As described above, when the circulation flow is generated, the evaporation speed at the nozzle steeply increases (see FIG. 27). Thus, an operation of increasing the temperature of the liquid ejection head 400 is started before the generation of the circulation flow in order to shorten a circulation flow generation period (the heating heater is turned on). In the embodiment, an output of a diode sensor provided in the print element board 420 is read by a controller 2613 to detect the temperature of the liquid ejection head 400. In addition, a temperature detector is not limited to the diode sensor and the other sensors may be used. The controller 2613 controls the ON/OFF state of the heating heater provided inside the liquid ejection head 400 in response to a detected temperature to adjust the temperature of the liquid ejection head 400.

The controller 2613 operates the first circulation pump 2609*a* and the first circulation pump 2609*b* after turning on the heating heater. Accordingly, the ink flows through the passage inside the liquid ejection head 400 and the above-mentioned circulation flow of the ink is generated by the ink flowing through the passage inside the nozzle (the start of the circulation). In the embodiment, the circulation flow rate reaches a predetermined speed (set as "V") within one second after the circulation starts. Here, a time in which the temperature of the liquid ejection head 400 reaches a predetermined temperature (set as "$T_{op}$") and a time in which the circulation flow rate reaches the predetermined speed V can be checked by a previous examination or the like. Thus, the first circulation pumps 2609*a* and 2609*b* are operated to start the circulation after a certain time elapses from the timing of turning on the heating heater so that a timing in which the temperature of the liquid ejection head 400 reaches the predetermined temperature $T_{op}$ and a timing in which the circulation flow rate reaches the predetermined speed V are substantially equal to each other. The circulation is started after a predetermined time elapses from the timing in which the heating heater is turned on. Accordingly, a difference between the timing in which the circulation flow rate of the ink reaches the predetermined speed V and the timing in which the image forming operation is started becomes substantially zero. At the timing in which the temperature of the liquid ejection head 400 reaches the predetermined temperature $T_{op}$ and the circulation flow rate reaches the predetermined speed V, the image forming operation of ejecting the ink is started. Further, in FIG. 29, the image forming operation of ejecting the ink is started at the same time when the temperature of the liquid ejection head 400 reaches the predetermined temperature $T_{op}$ and the circulation flow rate reaches the predetermined speed V. However, the image forming operation of ejecting the ink may be started at an arbitrary timing if the temperature of the liquid ejection head 400 reaches the predetermined temperature $T_{op}$ and the circulation flow rate reaches the predetermined speed V.

An evaporation component from the circulation system during the ink ejecting operation (the image forming operation) mainly corresponds to an evaporation component from the nozzle (hereinafter, also referred to as "non-ejection nozzle") that is not used for the image forming operation and does not eject the ink. The evaporation of the ink from the non-ejection nozzle increases the color concentration of the ink inside the circulation system. Since the circulation flow rate of each nozzle cannot be individually controlled, the evaporation speed for each non-ejection nozzle during the ink ejecting operation (the image forming operation) is constant.

After the ink ejecting operation (the image forming operation) ends, the operations of the first circulation pumps 2609*a* and 2609*b* are stopped to stop the circulation. A time necessary until the circulation flow inside the nozzle completely stops is within one second. As illustrated in FIG. 29, when the operations of the first circulation pumps 2609*a* and 2609*b* are stopped, the evaporation speed at the non-ejection nozzle steeply decreases.

Next, the controller 2613 closes the cap 2614 of the liquid ejection head. Accordingly, the humidity of the nozzle portion increases to be recovered to the humidity RH1 before the printing job is received (in the standby state) and the evaporation speed at the non-ejection nozzle converges to zero. Finally, the printing apparatus returns to a standby state.

In the embodiment, as illustrated in FIG. 26, a bypass passage 2610 for completely stopping the circulation flow at an early timing is provided. The bypass passage 2610 is normally closed by a valve 2602*d*, but is opened at the same time when the operations of the first circulation pumps 2609*a* and 2609*b* are stopped after the ink ejecting operation (the image forming operation) ends.

The reason why such a bypass passage 2610 is provided is as below. A compliance component caused by the configuration of the negative pressure control unit and bubbles exist inside the passage. Further, a flow resistance component also exists in the nozzle portion of the circulation system. Even when the operations of the first circulation pumps 2609*a* and 2609*b* are stopped due to these components, some time is necessary until the pressures of the common supply passage and the common collection passage are equal to each other (until the differential pressure is removed) and some time is necessary until the circulation flow completely stops. Thus, as illustrated in FIG. 26, the bypass passage 2610 having a flow resistance sufficiently smaller than the combined resistance of the nozzle portion of the liquid ejection head 400 is provided and the bypass passage 2610 is opened at the same time when the operations of the first circulation pumps 2609*a* and 2609*b* are stopped. Accordingly, the combined resistance of the liquid ejection head 400 and the bypass passage 2610 decreases and thus a time necessary for the complete stop of the circulation flow can be shortened.

In addition, the circulation system and the sequence described above may be provided for each color and the circulation operation in the circulation system of the color not used for the printing process may be stopped. Alternatively, a case may be assumed in which any one of a monochrome printing process and a color printing process is selectively performed. Then, the printing apparatus may include at least two circulation systems (that is, a monochrome circulation system for the monochrome printing process and a color circulation system for the color printing process). In such a configuration, at the time when the monochrome printing process is performed, the circulation system of the color printing process does not generate the circulation flow. Meanwhile, at the time when the color printing process is performed, the circulation system for the monochrome printing process does not generate the circulation flow. With such a configuration, the concentration of the black ink and the color ink can be suppressed.

Figure 31:
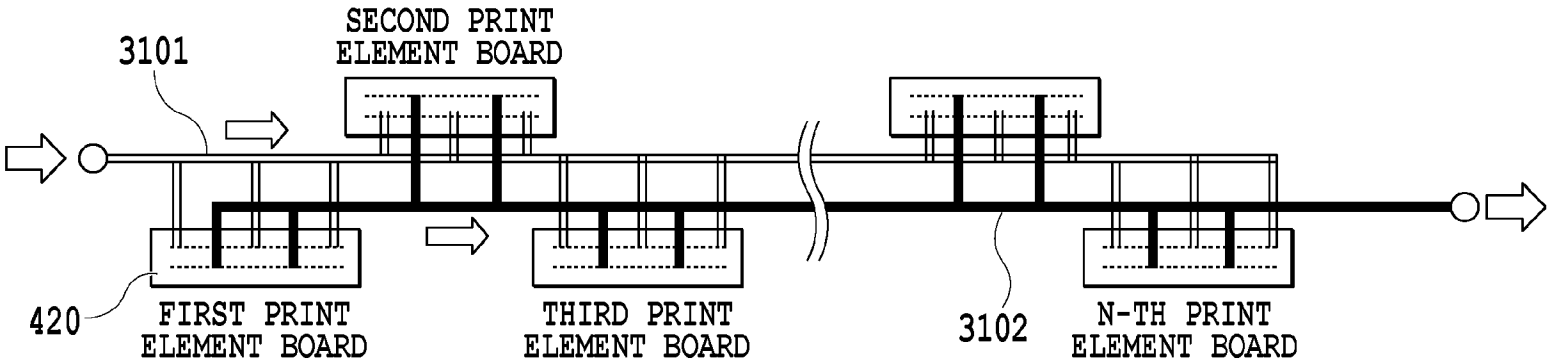
FIG. 31 is a schematic diagram illustrating a passage inside the liquid ejection unit according to the embodiment.

Further, in the description above, the liquid ejection unit (see FIGS. 25 and 26) provided with two combinations of the liquid supply inlet, the common passage, and the liquid discharge outlet has been described, but the embodiment can be also applied to the liquid ejection unit having a different configuration. For example, the liquid ejection unit may be a liquid ejection unit having a configuration illustrated in FIG. 31 in which one inlet is provided at the upstream side of a common supply passage 3101, one outlet is provided at the downstream side of a common collection passage 3102, and the print element boards 420 are respectively connected to the common passages. That is, the embodiment can be also applied to a liquid ejection unit having an arbitrary configuration forming a part of a circulation system in which a liquid is supplied and is discharged.

Further, in the description above, a case has been described in which a printing process is performed on the basis of one printing job. However, the embodiment can be also applied to a case where a printing process (for example, a reservation printing process) is performed on the basis of a plurality of printing jobs. In this case, the cap is opened and the heater of the liquid ejection head is turned on to generate the circulation flow immediately before the image forming operation of ejecting the ink on the basis of the first printing job among the plurality of printing jobs of the printing target is started. Then, after the image forming operation of ejecting the ink on the basis of the final printing job among the plurality of printing jobs of the printing target ends, the circulation flow is stopped, the heater of the head is turned off, and the cap is closed.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s)

and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the invention, since the evaporation of the volatile component included in the liquid flowing through the circulation system from the ejection opening is suppressed, an increase in concentration of the liquid can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-002825, filed Jan. 8, 2016, which is hereby incorporated by reference wherein in its entirety.

What is claimed is:

1. A printing apparatus comprising:

a page wide type liquid ejection head that includes an ejection opening ejecting a liquid, a print element generating energy for ejecting a liquid, a pressure chamber having the print element provided therein, and a heater increasing a temperature of a liquid; and a circulator configured to circulate the liquid so that the liquid passes through the pressure chamber, wherein a circulation of the liquid is started after an adjustment of a temperature by the heater is started and the circulation of the liquid is stopped in a case where an image forming operation of ejecting the liquid from the ejection opening on the basis of a job is ended.

2. The printing apparatus according to claim 1, wherein a time taken until a circulation flow rate of the liquid reaches a predetermined speed after the circulation of the liquid is started is shorter than a time taken until a temperature of the page wide type liquid ejection head reaches a predetermined temperature after the adjustment of the temperature by the heater is started.

3. A printing apparatus comprising:

a page wide type liquid ejection head that includes an ejection opening ejecting a liquid, a print element generating energy for ejecting a liquid, a pressure chamber having the print element provided therein, and a heater increasing a temperature of a liquid;

a cap that covers the ejection opening; and a circulator configured to circulate the liquid so that the liquid passes through the pressure chamber, wherein an adjustment of a temperature by the heater is started after the cap is opened, wherein a circulation of the liquid is started after the adjustment of the temperature is started, wherein an image forming operation of ejecting the liquid from the ejection opening on the basis of a job is started after the circulation of the liquid is started, and wherein in a case where the image forming operation is ended, the adjustment of the temperature is ended, the circulation of the liquid is stopped, and the cap is closed.

4. A printing apparatus comprising:

a page wide type liquid ejection head that includes an ejection opening ejecting a liquid, a print element generating energy for ejecting a liquid, and a pressure chamber having the print element provided therein;

a cap that covers the ejection opening; and a circulator configured to circulate the liquid so that the liquid passes through the pressure chamber, wherein a circulation of the liquid is started after the cap is opened and the circulation of the liquid is stopped in a case where an image forming operation of ejecting the liquid from the ejection opening on the basis of a job is ended, and wherein the liquid includes a plurality of colors of ink, the printing apparatus includes liquid circulation systems respectively corresponding to the plurality of colors of ink, and the liquid circulation systems are individually controlled.

5. A printing apparatus comprising:

a page wide type liquid ejection head that includes an ejection opening ejecting a liquid, a print element generating energy for ejecting a liquid, and a pressure chamber having the print element provided therein;

a cap that covers the ejection opening; and a circulator configured to circulate the liquid so that the liquid passes through the pressure chamber, wherein a circulation of the liquid is started after the cap is opened and the circulation of the liquid is stopped in a case where an image forming operation of ejecting the liquid from the ejection opening on the basis of a job is ended, wherein the printing apparatus includes a monochrome circulation system and a color circulation system, and wherein the circulation of the liquid is not generated in the color circulation system in a case of a monochrome printing process and the circulation of the liquid is not generated in the monochrome circulation system in a case of a color printing process.

6. A printing apparatus comprising:

a page wide type liquid ejection head that includes an ejection opening ejecting a liquid, a print element generating energy for ejecting a liquid, and a pressure chamber having the print element provided therein;

a cap that covers the ejection opening; and a circulator configured to circulate the liquid so that the liquid passes through the pressure chamber, wherein a circulation of the liquid is started after the cap is opened and the circulation of the liquid is stopped in a case where an image forming operation of ejecting the liquid from the ejection opening on the basis of a job is ended, wherein the page wide type liquid ejection head further includes a common supply passage that communicates with all pressure chambers and supplies a liquid to all of the pressure chambers and a common collection passage that communicates with all of the pressure chambers and collects the liquid from all of the pressure chambers, wherein the printing apparatus further comprises a bypass passage that is provided at the downstream side of the page wide type liquid ejection head to fluid-connect a passage connected to the common supply passage to a passage connected to the common collection passage, and wherein in a case where the image forming operation is ended, the bypass passage is opened to remove a differential pressure between the common supply passage and the common collection passage.

7. A printing apparatus comprising:

a page wide type liquid ejection head that includes an ejection opening ejecting a liquid, a print element generating energy for ejecting a liquid, a pressure chamber having the print element provided therein, and a heater increasing a temperature of a liquid; and a circulator configured to circulate the liquid so that the liquid passes through the pressure chamber, wherein the printing apparatus performs at least the following steps in the order named:

receiving a printing job;

starting an adjustment of a temperature by the heater;

starting a circulation of the liquid; and ejecting the liquid from the ejection opening, and starting printing.

8. The printing apparatus according to claim 7, wherein the circulator includes a plurality of pumps.

9. The printing apparatus according to claim 7, wherein the page wide type liquid ejection head includes first and second negative pressure control units.

10. The printing apparatus according to claim 7, wherein the page wide type liquid ejection head includes a common supply passage that communicates with the first negative pressure control unit and supplies a liquid to the pressure chambers and a common collection passage that communicates with the second negative pressure control unit and collects the liquid from the pressure chambers.

11. A printing method performed by a printing apparatus in which the printing apparatus comprises a page wide type liquid ejection head that includes an ejection opening ejecting a liquid, a print element generating energy for ejecting a liquid, a pressure chamber having the print element provided therein, and a heater increasing a temperature of a liquid; and a circulator configured to circulate the liquid so that the liquid passes through the pressure chamber, wherein the printing method comprises at least the following steps performed by the printing apparatus in the order named:

receiving a printing job;

starting an adjustment of a temperature by the heater;

starting a circulation of the liquid; and ejecting the liquid from the ejection opening, and starting printing.

* * * * *